US006963721B2

(12) United States Patent
Asai et al.

(10) Patent No.: US 6,963,721 B2
(45) Date of Patent: Nov. 8, 2005

(54) IMAGE FORMING APPARATUS HAVING FUNCTION OF AUTOMATICALLY SELECTING ONE OF SHEET FEEDERS, METHOD OF CONTROLLING THE IMAGE FORMING APPARATUS AND STORAGE MEDIUM

(75) Inventors: Hidehiko Asai, Kanagawa (JP); Yasushi Shimizu, Kanagawa (JP); Kazuhiro Kasai, Kanagawa (JP)

(73) Assignee: Canon Kabushiki Kaisha, (JP)

( * ) Notice: Subject to any disclaimer, the term of this patent is extended or adjusted under 35 U.S.C. 154(b) by 0 days.

(21) Appl. No.: 10/764,884

(22) Filed: Jan. 26, 2004

(65) Prior Publication Data

US 2004/0156649 A1 Aug. 12, 2004

Related U.S. Application Data

(63) Continuation of application No. 09/859,900, filed on May 17, 2001, now Pat. No. 6,785,507.

(30) Foreign Application Priority Data

May 17, 2000 (JP) ..... 2000-145301

(51) Int. Cl.[7] ..... G03G 15/00

(52) U.S. Cl. ..... 399/391; 399/45

(58) Field of Search ..... 399/10, 83, 393, 399/370, 376, 407, 408; 271/9.01, 9.06, 9.03, 271/9.05, 265.01

(56) References Cited

U.S. PATENT DOCUMENTS

| | | | | |
|---|---|---|---|---|
| 4,473,314 | A | 9/1984 | Imaizumi | 400/625 |
| 4,573,789 | A | 3/1986 | Wada | |
| 4,597,663 | A | 7/1986 | Yoshiura et al. | |
| 4,693,459 | A | 9/1987 | Shimoda et al. | 271/9 |
| 4,885,613 | A | 12/1989 | Kudoh | |
| 4,947,206 | A | 8/1990 | Ito | |
| 5,130,757 | A | 7/1992 | Ito | |
| 5,221,951 | A | 6/1993 | Sakamoto | |
| 5,289,236 | A | 2/1994 | Yoshino | |
| 5,390,005 | A | 2/1995 | Kimoto et al. | |
| 5,420,669 | A | 5/1995 | Imada | |
| 5,762,329 | A | 6/1998 | Nakazato et al. | 270/58.09 |
| 5,959,742 | A | 9/1999 | Momose et al. | 358/449 |
| 6,356,735 | B1 | 3/2002 | Hozumi | 399/395 |
| 6,785,507 | B2 * | 8/2004 | Asai et al. | 399/407 |

FOREIGN PATENT DOCUMENTS

| | | |
|---|---|---|
| JP | 58-31834 A | 2/1983 |
| JP | 5-147757 A | 6/1993 |
| JP | 7-234610 A | 9/1995 |
| JP | 11-48580 A | 2/1999 |

* cited by examiner

*Primary Examiner*—Susan Lee
(74) *Attorney, Agent, or Firm*—Rossi, Kimms & McDowell, LLP

(57) ABSTRACT

An image forming apparatus that forms images of originals on sheets, includes a plurality of feeders for feeding sheets, a memory for storing sheet types in association with the plurality of feeders, and storing the priority between the sheet types, and a selector for selecting one of the plurality of feeders to be used for a sheet feeding operation in accordance with the sheet types and the priority stored in the memory.

37 Claims, 18 Drawing Sheets

IMAGE FORMING APPARATUS HAVING FUNCTION OF AUTOMATICALLY SELECTING ONE OF SHEET FEEDERS, METHOD OF CONTROLLING THE IMAGE FORMING APPARATUS AND STORAGE MEDIUM

This is a continuation of application Ser. No. 09/859,900, filed 17 May 2001, which is now U.S. Pat. No. 6,785,507.

BACKGROUND OF THE INVENTION

1. Field of the Invention

The present invention relates to an image forming apparatus that has a function of automatically selecting one of a plurality of sheet feeders, and more particularly to an image forming apparatus that is suitable for performing a sheet feeding operation as desired by a user, a method of controlling the image forming apparatus, and a storage medium storing a control program for implementing the method.

2. Related Art

In recent years, there has been developed a digital image forming apparatus that has an automatic sheet selecting function in which the size of a read original is determined and an optimum sheet feeding port is automatically selected according to the determined sheet size. In such an image forming apparatus with an automatic sheet selecting function, in the case where the optimum sheet feeding port is selected from a plurality of sheet feeding ports, when a switch for setting inhibition of selection of a sheet feeding port (hereinafter referred to as "selection-inhibiting switch"), provided in the image forming apparatus, is turned on, a sheet feeding port associated with the switch is excluded from sheet feeding ports to be selected.

In the digital image forming apparatus, it is required to set sheet types for the respective sheet feeding ports so that a user can confirm types of sheets stored in the sheet feeding ports when he inputs a desired sheet type for a specific sheet feeding port to carry out image formation and output the formed image. If sheets of an improper type are stored in association with the specific sheet feeding port, the user selects a different sheet feeding port to carry out image formation and output the formed image.

In the above conventional digital image forming apparatus, however, even if the sheet type has already been designated, if there is a sheet feeding port that can feed sheets of the same size as the sheet size input by the user and on which images are to be formed, the above sheet feeding port is automatically selected to feed sheets irrespective of the set sheet type. To exclude the sheets of the same size from sheets to be selected, the selection-inhibiting switch has to be turned on. To stop sheet feeding when a desired copying mode is not selected, the switch has to be reset.

In a digital composite apparatus (an apparatus having a plurality of functions such as an image reading function, an image forming function, and a facsimile function) having three sheet feeding ports, for example, when prepunched or colored paper, recycled paper and ordinary paper are stored in sheet feeding ports 1, 2 and 3, respectively, a sheet feeding port that feeds sheets of the same size as the sheet size input by the user is automatically selected in a mode in which a sheet feeding port is automatically selected, irrespective of the sheet type. For example, if the sheets stored in all the sheet feeding ports are of A4 size and the sheet size input by the user is also of A4 size, the sheet feeding port for prepunched paper can be automatically selected, even though he wishes to copy the original on ordinary paper.

SUMMARY OF THE INVENTION

The present invention has been made in view of the above described problems, and it is an object of the present invention to provide an image forming apparatus, and a method of controlling the image forming apparatus, which are capable of performing sheet feeding in a manner more conforming to a user's desire than the conventional function, when automatic selection of sheets or automatic change of sheet feeding port in the event of sheet depletion is carried out, and a storage medium storing a control program for implementing the method.

To attain the above object, the present invention provides an image forming apparatus for forming images of originals on sheets, comprising a plurality of feeders for feeding sheets, a memory for storing sheet types in association with the plurality of feeders, and a selector for selecting one of the plurality of feeders to be used for a sheet feeding operation in accordance with the sheet types stored in the memory.

Preferably, the image forming apparatus according to the present invention further comprises an operating section through which a user carries out various settings related to the image forming apparatus, and the sheet types stored in the memory are set through the operating section.

Also preferably, the image forming apparatus according to the present invention further comprises an predetermined type.

Preferably, the image forming apparatus according to the present invention further comprises a post processor for carrying out post processing on sheets having images formed thereon, and the selector selects a feeder in accordance with a type of the post processing carried out by the post processor and the sheet types stored in the memory.

In a preferred embodiment, the selector selectively executes either a first mode of operation in which selection is made from among feeders containing sheets of a first type, or a second mode of operation in which selection is made from among feeders containing sheets of the first type and feeders containing sheets of a second type.

To attain the above object, the present invention provides a method of controlling an image forming apparatus including a plurality of feeders for feeding sheets and for forming images of originals on sheets, the method comprising a first step of storing sheet types in association with the plurality of feeders, a second step of storing order of priority between the sheet types, and a third step of selecting one of the plurality of feeders to be used for a sheet feeding operation in accordance with the sheet types stored in the first step and the order of priority stored in the second step. operating section through which a user carries out various settings related to the image forming apparatus, and the order of priority stored in the memory is set through the operating section.

In a preferred form, the image forming apparatus according to the present invention further comprises a detector for detecting a size of an original, and the memory stores sheet sizes in association with the plurality of feeders, and the selector selects one of the plurality of feeders to be used for the sheet feeding operation in accordance with the size of the original detected by the detector, and the sheet types, the order of priority, and the sheet sizes stored in the memory.

Preferably, the selector carries out selection of one of the plurality of feeders upon start of an image forming operation by the image forming apparatus.

Alternatively, the selector carries out selection of one of the plurality of feeders when a feeder being used has run short of sheets during an image forming operation by the image forming apparatus.

More preferably, the selector selects a feeder that contains sheets of the same type as the type of the sheet contained in the feeder which has run short of sheets.

Preferably, the selector selects a feeder other than a feeder containing sheets of at least one Preferably, the image forming apparatus includes an operating section through which a user carries out various settings related to the image forming apparatus, the sheet types stored in the first step being set through the operating section.

Preferably, the image forming apparatus includes an operating section on which a user carries out various settings related to the image forming apparatus, the order of priority stored in the second step being set through the operating section.

In a preferred form, the method of controlling an image forming apparatus according to the present invention further comprises a fourth step of detecting a size of an original, and a fifth step of storing sheet sizes in association with the plurality of feeders, and the third step comprises selecting one of the plurality of feeders to be used for the sheet feeding operation in accordance with the size of the original detected in the fourth step, the sheet types stored in the first step, the order of priority stored in the second step, and the sheet sizes stored in the fifth step.

Preferably, the third step comprises carrying out selection of one of the plurality of feeders upon start of an image forming operation by the image forming apparatus.

Preferably, the third step comprises carrying out selection of one of the plurality of feeders when a feeder being used has run short of sheets during an image forming operation by the image forming apparatus.

More preferably, the third step comprises selecting a feeder that contains sheets of the same type as the type of the sheet contained in the feeder which has run short of sheets.

Preferably, the third step comprises selects a feeder other than a feeder containing sheets of at least one predetermined type.

Preferably, the image forming apparatus includes a post processor for carrying out post processing on sheets having images formed thereon, and the third step comprises selecting a feeder in accordance with a type of the post processing carried out by the post processor and the sheet types stored in the memory.

In a preferred embodiment, the image forming apparatus includes a plurality of feeders for feeding sheets and for forming images of originals on sheets, and the method comprises a first step of storing sheet types in association with the plurality of feeders, and a second step of selecting one of the plurality of feeders to be used for a sheet feeding operation in accordance with the sheet types stored in the first step, and the second step comprises selectively executing either a first mode of operation in which selection is made from among feeders containing sheets of a first type, or a second mode of operation in which selection is made from among feeders containing sheets of the first type and feeders containing sheets of a second type.

To attain the above object, the present invention provides a storage medium storing a control program for controlling an image forming apparatus including a plurality of feeders for feeding sheets and for forming images of originals on sheets, the storage medium being readable by the image forming apparatus, the control program comprising a first code for storing sheet types in association with the plurality of feeders, a second code for storing order of priority between the sheet types, and a third code for selecting one of the plurality of feeders to be used for a sheet feeding operation in accordance with the sheet types stored in the first code and the order of priority stored in the second code.

To attain the above object, the present invention also provides a storage medium storing a control program for controlling an image forming apparatus including a plurality of feeders for feeding sheets and for forming images of originals on sheets, the storage medium being readable by the image forming apparatus, the control program comprising a first code for storing sheet types in association with the plurality of feeders, and a second code for selecting one of the plurality of feeders to be used for a sheet feeding operation in accordance with the sheet types stored in the first code, and the second code executes either a first mode of operation in which selection is made from among feeders containing sheets of a first type, or a second mode of operation in which selection is made from among feeders containing sheets of the first type and feeders containing sheets of a second type.

According to the present invention, by setting the sheet type beforehand, it is possible to achieve a sheet feeding operation in a manner better meeting the user's desire than with the conventional functions, in automatic selection of sheets and automatic cassette change in the event of sheet exhaustion. Further, it is possible to overcome the disadvantage with the prior art that automatic sheet selection had to be set again for each mode depending on the copy mode. Thus, the user can perform a copying operation with the automatic sheet selection function without worrying about the copy mode.

The above and other objects, advantages and features of the present invention will be more apparent from the following detailed description taken in conjunction with the accompanying drawings.

DETAILED DESCRIPTION OF THE PREFERRED EMBODIMENTS

The present invention will now be described in detail with reference to the drawings showing embodiments thereof.

[First Embodiment]

Figure 2:
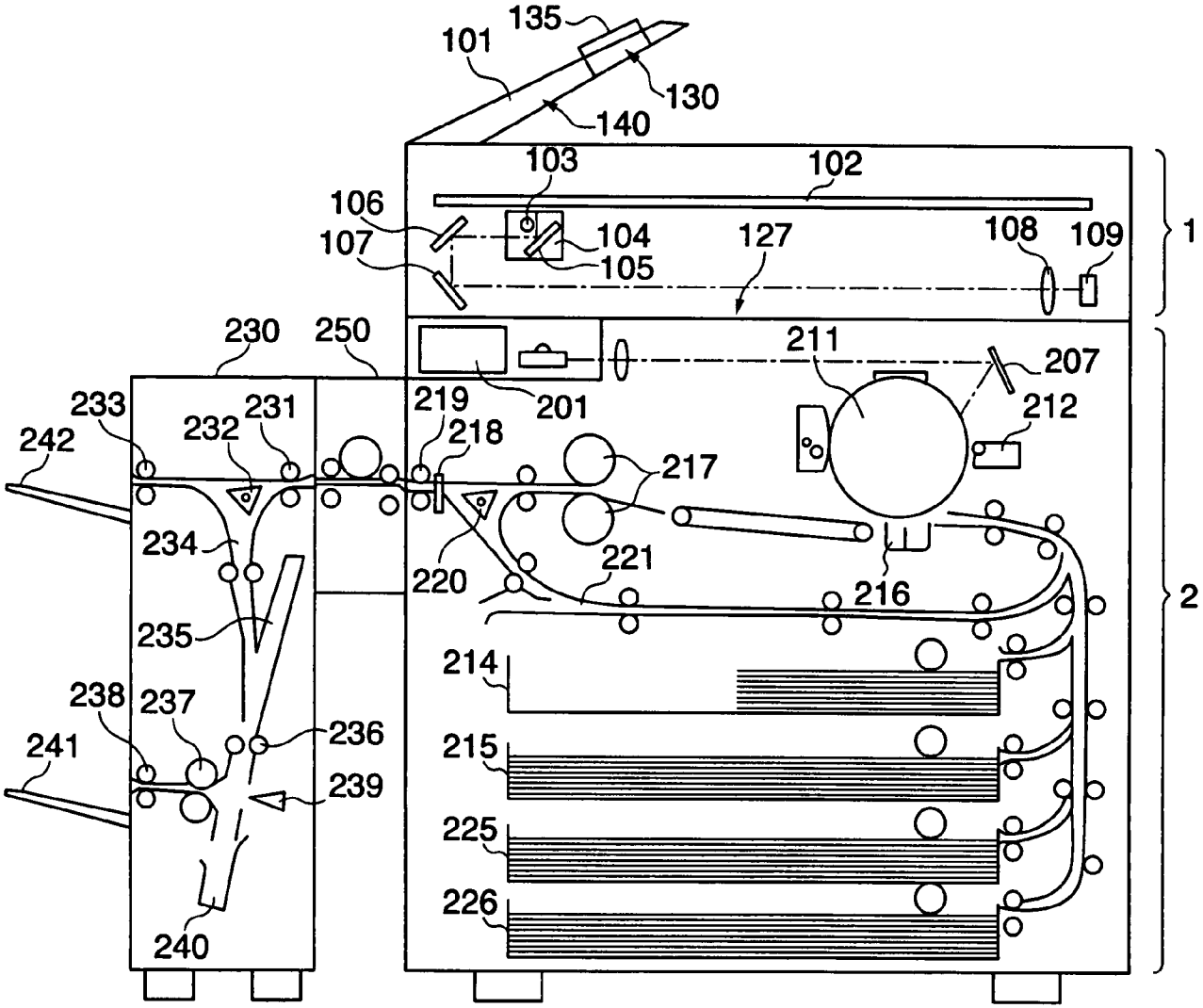
FIG. 2 is a view showing the general construction of the image forming apparatus according to the first embodiment.
Figure 3:
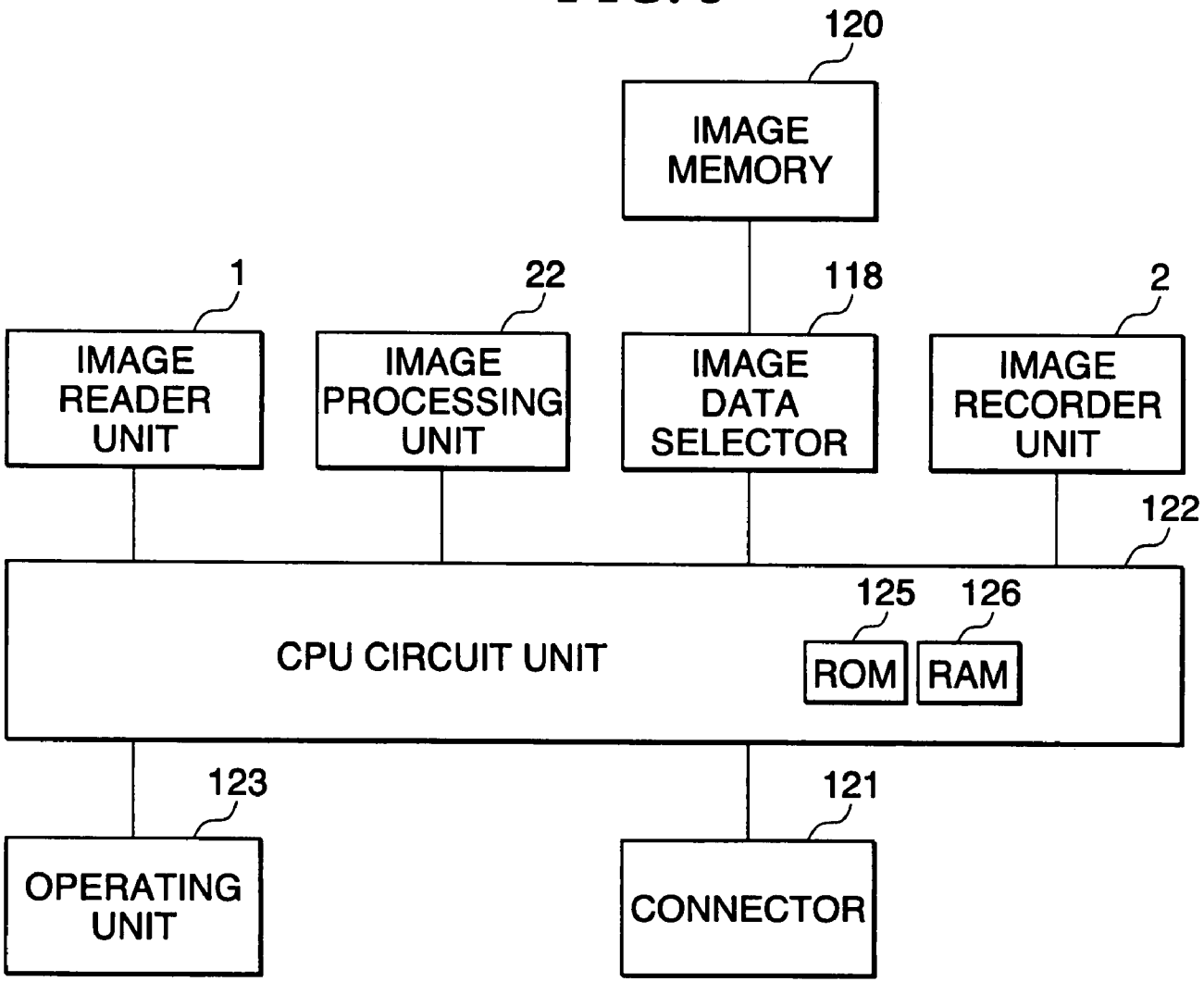
FIG. 3 is a block diagram showing the construction of a CPU circuit section and its related parts of the image forming apparatus according to the first embodiment.

FIG. 2 is a view showing the internal construction of an image forming apparatus (copying machine) according to a first embodiment of the present invention. The image forming apparatus according to the first embodiment is comprised of a reader section 1, a printer section 2, a sorter section 230, and a punching unit 250. The reader section 1 is comprised of an original document feeder 101, a glass platen 102, a scanner unit 104 including a lamp 103 and a mirror 105, a mirror 106, a mirror 107, a lens 108, and a CCD image sensor (hereinafter referred to as "the CCD"). The printer section 2 is comprised of an exposure controller 201, a polygon mirror 207, a photosensitive drum 211, a developing unit 212, a transfer unit 216, a fixing unit 217, a sheet discharging unit 218, a discharging roller 219, a conveyance direction switching member 220, a refeeding sheet stacking unit 221, sheet stacking units 214, 215, 225, 226. The sorter section 230 includes bins 241, 242 and others.

Originals stacked on the original document feeder 101 are successively fed one by one onto the glass platen 102. When each original is conveyed to a predetermined position on the glass platen 102, the lamp 103 is turned on and the scanner unit 104 is moved to irradiate the original. The reflected light from the original is guided via the mirrors 105, 106, 107, and the lens 108, and is input to the CCD 109. Details of the printer section 2 will be described later.

The sorter section 230 is comprised of an entrance roller 231, a conveyance path switching member 232, a sheet discharging roller 233, a longitudinal conveyance path 234, a saddle stacker 235, a saddle positioning roller 236, a saddle abutting roller 237, a saddle abutting member 239, and a saddle positioning member 240.

Figure 1:
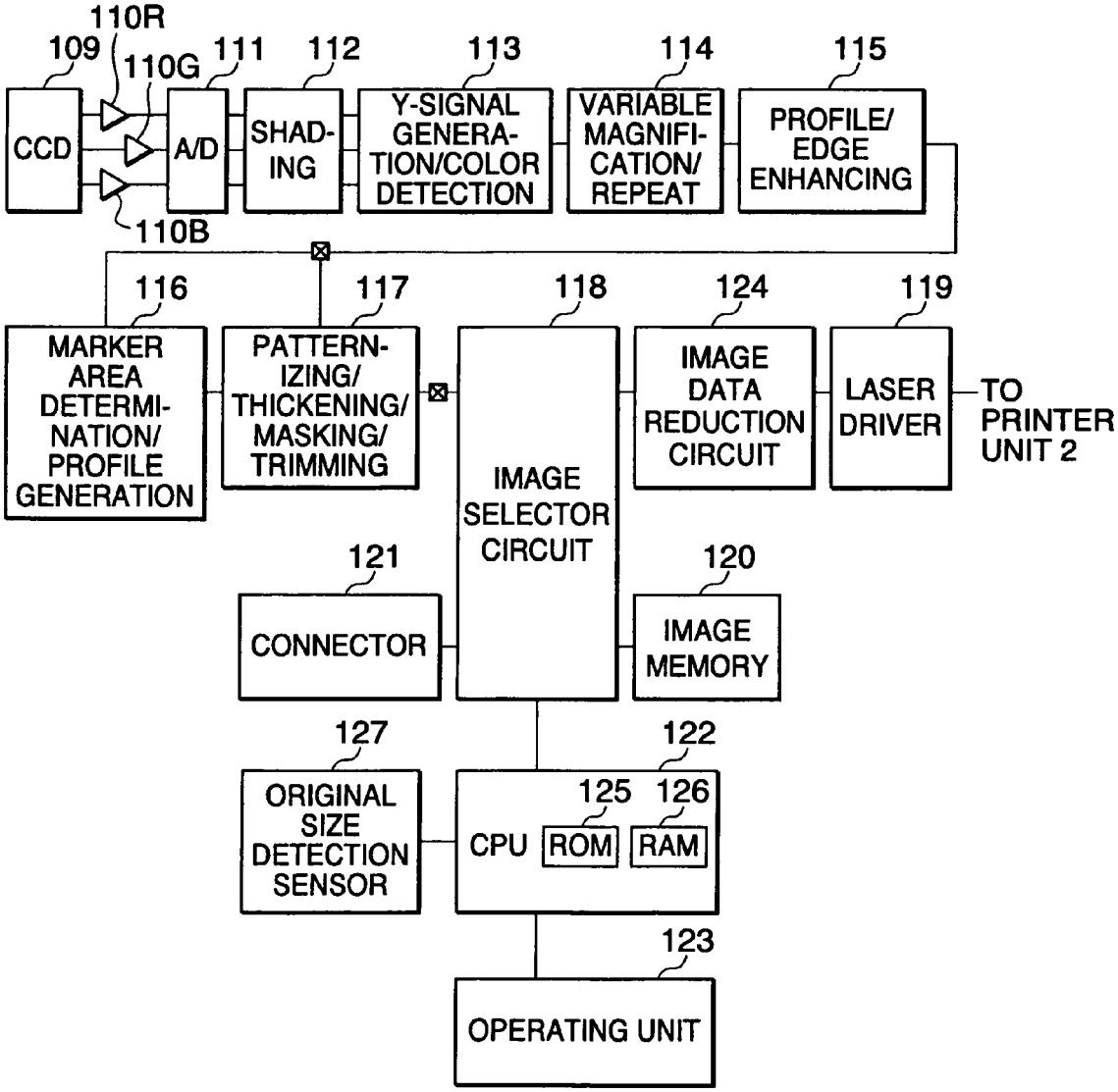
FIG. 1 is a block diagram showing the construction of a signal processing part of a reader section of an image forming apparatus according to a first embodiment of the present invention.

FIG. 1 is a block diagram showing the construction of a signal processing part of the reader section 1 of the image forming apparatus according to the first embodiment. The reader section 1 of the image forming apparatus according to the first embodiment is comprised of a CCD 109, amplifiers 110R, 110G, 110B, an A/D converter 111, a shading circuit 112, a Y-signal generation/color detection circuit 113, a variable power/repeat circuit 114, a profile/edge enhancing circuit 115, a marker area determination/profile generation circuit 116, a patterning/thickening/masking/trimming circuit 117, an image selector circuit 118, a laser driver circuit 119, an image memory 120, a connector 121, a CPU circuit 122 including a ROM 125 and a RAM 126, an operating section 123, an image data reduction circuit 124, and an original size sensor 127.

The above construction will next be described in detail together with its operation. The reflected light from the original is irradiated on the CCD 109, whereby photoelectric conversion takes place to produce electric signals R, G, B representing respective colors of Red, Green and Blue. The color signals from the CCD 109 are amplified by the following amplifiers 110R, 110G, and 110B into the input signal level for the A/D converter 111. The output signals from the A/D converter 111 are input to the shading circuit 112, where unevenness of light intensity distribution of the lamp 103 and uneveness of the sensitivity of the CCD 109 are corrected. Signals from the shading circuit 112 are input to the Y-signal generation/color detection circuit 113 as well as to an external I/F switching circuit, not shown.

The Y-signal generation/color detection circuit 113 includes a Y-signal generation circuit that performs an operation on the signals from the shading circuit 112 according to the following equation to obtain a Y-signal:

$$Y=0.3R+0.6G+0.1B$$

The Y-signal generation/color detection circuit 113 includes a color detection circuit that separates the signals R, G, and B into seven colors to output signals for the respective colors. Output signals from the Y-signal generation/color detection circuit 113 are input to the variable power/repeat circuit 114.

Variable powering in the subscanning direction is carried out by adjusting the scanning speed of the scanner unit 104, while variable powering in the main scanning direction is carried out by the variable power/repeat circuit 114. A plurality of copies of the same image can be output by the variable power/repeat circuit 114. The profile/edge enhancing circuit 115 enhances high frequency components of a signal from the variable power/repeat circuit 114 to obtain edge enhancement and profile information. A signal from the profile/edge enhancing circuit 115 is input to the marker area determination/profile generation circuit 116 as well as to the patterning/thickening/masking/trimming circuit 117.

The marker area determination/profile generation circuit 116 reads out an area written with a marker pen of designated color on the original to produce marker profile information. The patterning/thickening/masking/trimming circuit 117 performs thickening, masking and/or trimming operation based on this profile information. The circuit 117 also performs patterning according to the detected color signal from the Y-signal generation/color detection circuit 113.

When an output signal from the patterning/thickening/masking/trimming circuit 117 is output to the printer section 2, it is selected by the image data selector 118, described later, wherefrom the signal thus subjected to various processes is input to the laser driver circuit 119, where the signal is converted into a signal for driving a laser. An output signal from the laser driver circuit 119 is input to the printer section 2, where image formation is carried out to form a visual image.

The image memory 120 stores, at a designated location thereof, the image data sent from the image data selector 118 in a manner described later in response to an instruction from the CPU circuit 122, and performs a rotation process and image synthesis on the memory.

The CPU circuit 122 controls the reader section 1, and is comprised of a ROM 125 storing control programs, an error processing program, and others, a RAM 126 serving as a work area for various programs, and various timer controllers. The original size detecting sensor 127 is arranged on the glass platen 102 to detect the size of an original and to output the detected size signal to the CPU 122. The CPU 122 determines the size of an original based on the detected size signal from the original size detecting sensor 127.

Figure 4:
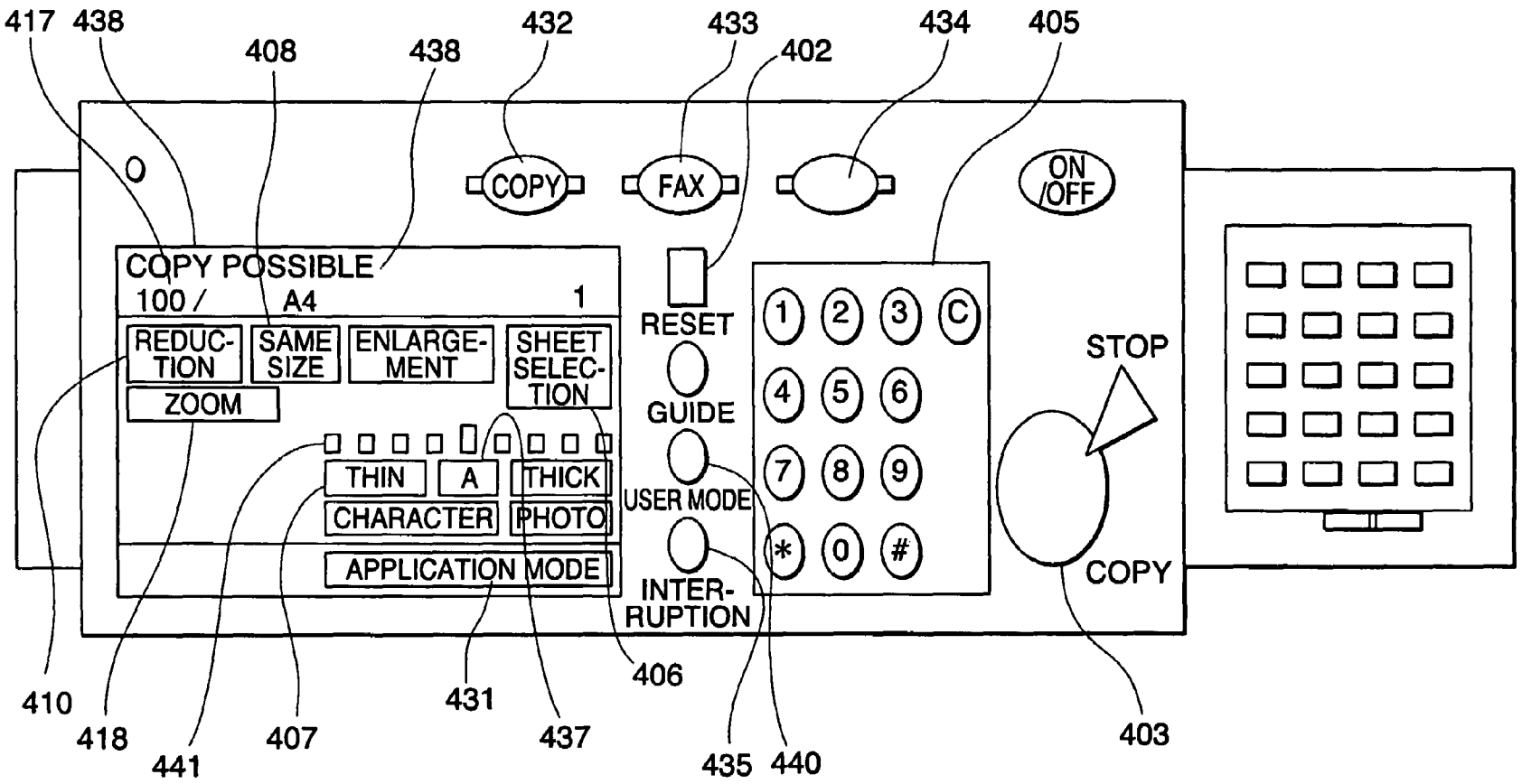
FIG. 4 is a front view showing the construction of an operating section of the image forming apparatus according to the first embodiment.

The operating section 123 is comprised of various key groups for instructing contents of image edition for image processing by the reader section 1 and an image forming operation including the number of copies to be generated, and a display section for displaying contents of operation, etc. FIG. 4 is a view showing details of the operating section 123 according to the present embodiment. Various keys and a liquid crystal display section 438 composed of a dot matrix, formed by a liquid display device, are arranged on this operating section 123.

The liquid crystal display section 438 displays the status of the apparatus, the number of copies to be generated, magnification, selected sheet type, and various operating screen views, and is operated using control keys 431 to 435 and others. A start key 403 is for starting a copying operation, and a reset key 402 is for resetting the set mode to the standard state. A key group 405 is comprised of ten-keys from 0 to 9 for inputting the number of copies, zooming magnification, and others, and a clear key for clearing the inputs of the keys. A density key 407 is for varying the density, and the density so adjusted is displayed on the liquid crystal display section 438.

A key group 437 is comprised of keys for switching turning on and off an automatic density adjusting function, and a display part. A key 406 is for selecting a sheet feeding port and automatic selection of sheets, and the selected port or automatic selection is displayed on the liquid crystal display section 438. Keys 408 and 410 are for setting, respectively, 100% magnification or equimultiplication and regular size reduction/enlargement. A key 418 and a display unit 417 are for setting an automatic variable magnification mode, and the selected status is also displayed on the liquid crystal display section 438. A key 440 is a user mode key for enabling individual users to perform their own settings. As described later, the sheet type is set by depressing this user mode key 440.

Next, the construction and operation of the printer section 2 will be described with reference to FIG. 2 described above. An image signal input to the printer section 2 is converted to a light signal after being modulated by the exposure controller 201 to be irradiated on the photosensitive drum 211. A latent image is formed on the photosensitive drum 211 and developed by the developing unit 212. In timing coincident with the leading end of the developed image, a sheet is conveyed from the sheet stacking unit (sheet feeding port) 214 or 215, and the developed image is transferred to the sheet by the transfer unit 216.

After the transferred image is fixed to the sheet by the fixing unit 217, the sheet is discharged from the apparatus via the sheet discharging unit 218. The sheet output via the sheet discharging unit 218 passes the punching unit 250, where it is punched when a punching function is actuated, and is delivered to the sorter section 230. In the sorter section 230, if the sort function is actuated, the sheet is discharged to a corresponding bin, and if the sort function is not actuated, the sheet is discharged to the uppermost bin in the sorter.

Next, a manner of outputting successively read images onto both sides of an output sheet will be described. An output sheet having an image fixed thereon by the fixing unit 217 is once conveyed to the sheet discharging unit 218, where it is reversed in sheet conveyance direction to be conveyed via the conveyance direction switching member 220 to the refeeding sheet stacking unit 221. When the next original is placed on the glass platen 102, an image on the original is read as in the above described process. Then, the sheet is fed from the refeeding sheet stacking unit 221 so that two original images can be output onto the front surface and back surface of the same output sheet.

Figure 5A:
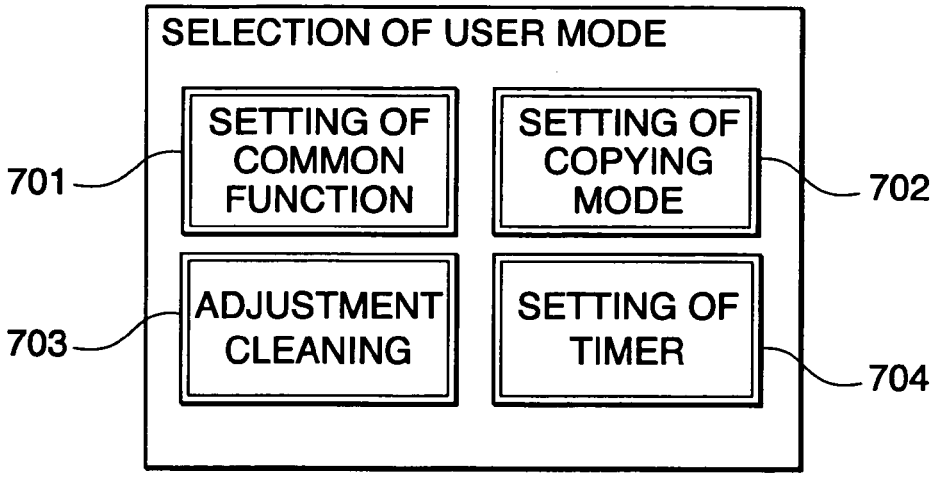
FIGS. 5A to 5F are views useful in explaining how to set types of sheets in the image forming apparatus according to the first embodiment.

A manner of setting the sheet type will now be described with reference to FIGS. 5A to 5F. Let it be assumed that sheets of B4 size, A4 size, A4 size, and A4 size are stored, respectively, in the sheet feeding ports 1, 2, 3, and 4. The sheet feeding ports 1, 2, 3, and 4 correspond, respectively, to the sheet stacking units 214, 215, 225, and 226 in FIG. 2. When the user mode key 440 of the operating section 123 is depressed, an operating screen view as shown in FIG. 5A is displayed on the liquid crystal display section 438. A key 701 is a common function setting key for setting a common function to the operation of the apparatus. A key 702 is a copying function setting key for making settings related to a copy function, for example, turning on and off automatic rotation. A key 703 is an adjustment cleaning key for setting zoom adjustment or the like. A key 704 is a timer key for setting date and time, etc.

Figure 5B:
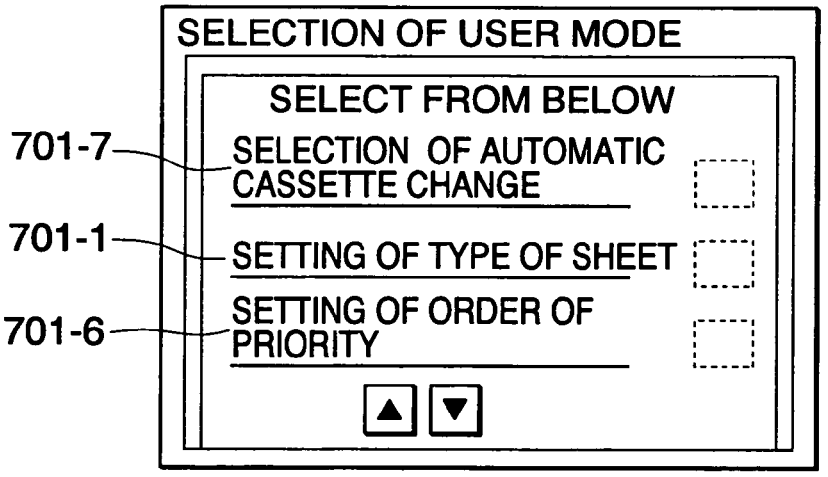
Figure 5C:
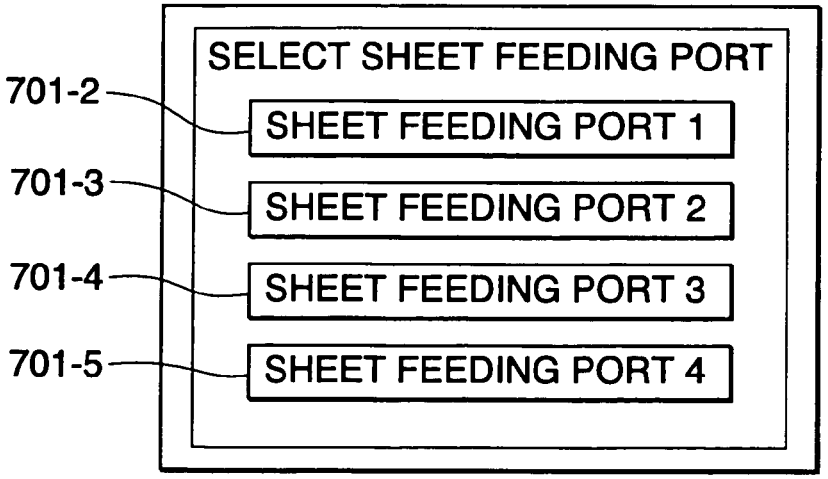
Figure 5D:
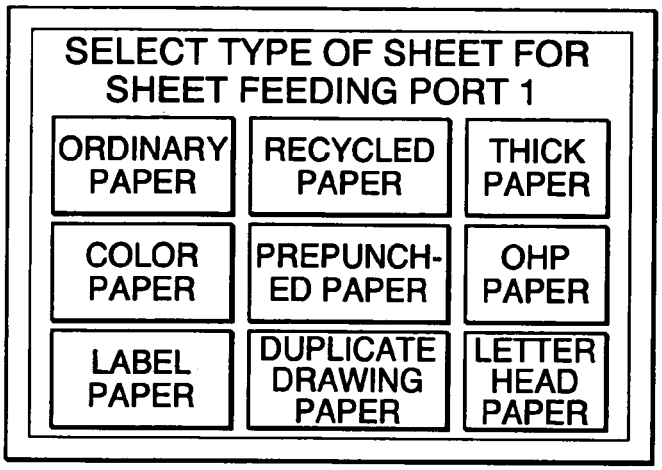

When the key 701 is depressed, an operating screen view as shown in FIG. 5B is displayed. A key 701-1 on this screen view is for setting the sheet type. When the key 701-1 is depressed, an operating screen view as shown in FIG. 5C is displayed. When one of keys 701-2 to 701-5 on this screen view is depressed, an operating screen view as shown in FIG. 5D is displayed so that the user can set a sheet type for each of the sheet feeding ports. By the operation of the user for designating in advance the sheet type for each of the sheet feeding ports, the image forming apparatus obtains the sheet type information and can determine the sheet type for each sheet feeding port.

Alternatively, the present invention may be constructed such that the sheet type can be determined by providing a reflection type optical sensor, not shown, at each of the sheet feeding ports and determining the sheet type according to the reflectance detected by the sensor. Further, as regards the sheet size information, the image forming apparatus may obtain this information from information input by the user through the operating section, or the image forming apparatus may be constructed such that the sheet size can be determined by size detection using a sensor.

In the present embodiment, if an image formation is to be performed using sheets of a specified type and size, and if sheets of the specified type are not present at the start of the image formation or are exhausted during the image forming operation, sheets of the same size but of different type may be selected according to a predetermined order of priority and the image forming operation may be performed on the selected sheets.

The sheet type information for each sheet feeding port, information on the order of priority between the sheet types, and information on setting of automatic cassette change, which are set by the user using operating screen views of FIG. 5C to FIG. 5F, are stored in the RAM 126 by the CPU circuit 122. The sheet size information that is set on a screen view, not shown, is also stored in the RAM 126 by the CPU circuit 122. The CPU circuit 122 reads out these kinds of information as necessary.

In this manner, the image forming apparatus can recognize what type and size of sheets are stacked in each of the sheet feeding ports, and can further recognize the order of priority between the sheet types (sheet feeding ports) to be used in the image formation.

The "thick paper" displayed on the operating screen view of FIG. 5D means a paper that is firmer than ordinary paper and is used as cover sheets or interleaved sheets for bookbinding. The "mother print paper" means a paper that is thinner and less firm than ordinary paper such as paper for engineering drawing paper, and the "punched paper" means a prepunched paper having previously punched holes at predetermined positions and hence requiring no punching process by the punching unit 250. The "label paper" means a paper for sealing, and the "letterhead paper" means a paper having an image such as a company logo formed in advance at a predetermined position.

Now, assuming that paper to be fed from the sheet feeding port 1 is set to ordinary paper, and, similarly, paper to be fed from the sheet feeding port 2 is set to colored paper, paper to be fed from the sheet feeding port 3 to recycled paper, and paper to be fed from the sheet feeding port 4 to ordinary paper.

Figure 5E:
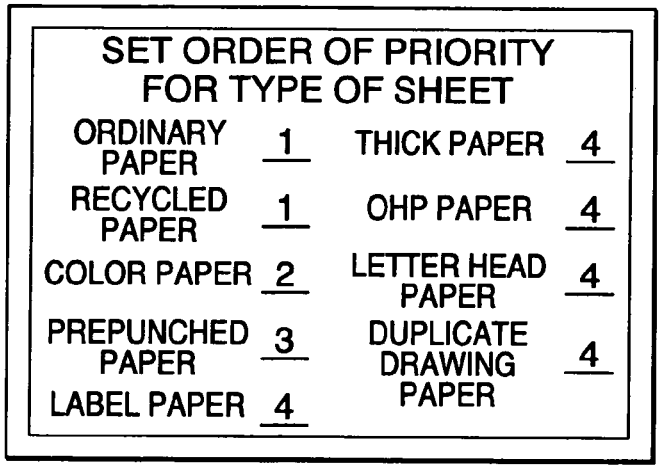

A key 701-6 appearing on the screen view of FIG. 5B is for setting the order of priority between different types of sheet. When this key is depressed, an operating screen view as shown in FIG. 5E is displayed. The order of priority for automatic sheet feeding selection of different sheet types can be set on this screen view. Now, let it be assumed that the order of priority is set to 1 for ordinary paper, 2 for recycled paper, 3 for colored paper, and 4 for thick paper.

Figure 5F:
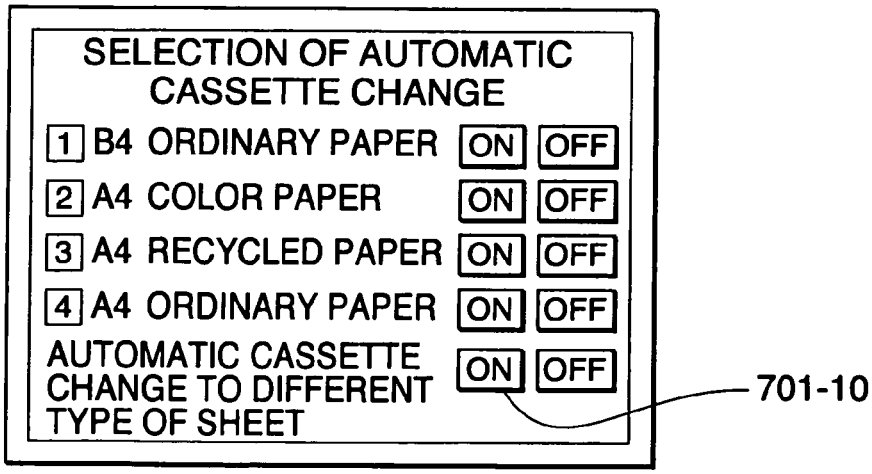

A key 701-7 appearing on the screen view of FIG. 5B is for setting whether change of sheet feeding port (automatic cassette change) is to be carried out or not in the event of sheet depletion in a sheet feeding port in use during image forming operation. When this key is depressed, an operating screen view as shown in FIG. 5F is displayed. A key 701-10, "Automatic cassette change to different sheet type", appears on this screen view, and upon depression of this key, the apparatus automatically selects a sheet feeding port according to the order of priority set in FIG. 5E.

Figure 18:
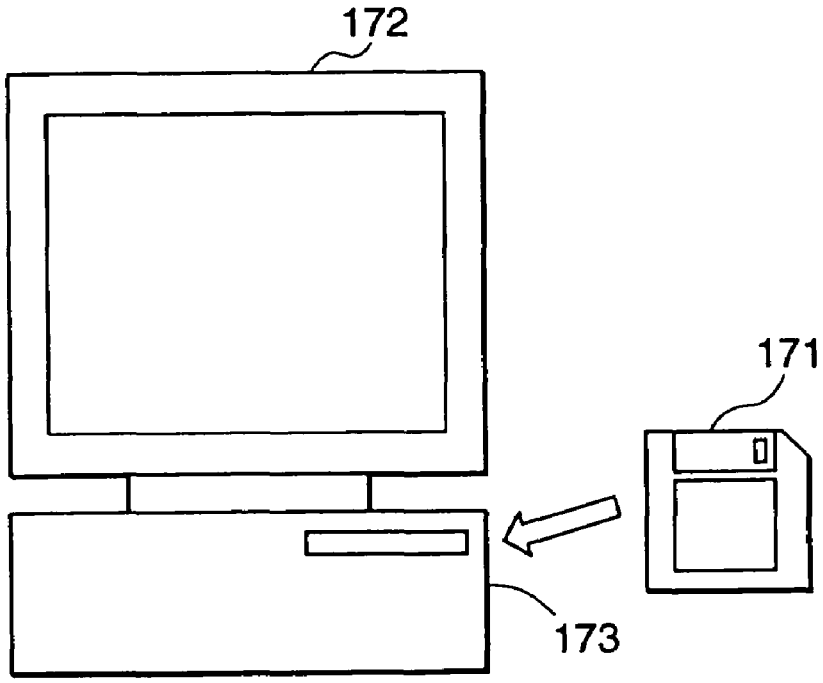
FIG. 18 is a view useful in explaining how to supply a program and its related data according to the present invention from a memory to the apparatus.

FIG. 18 is a view useful in explaining how to supply a program and its related data according to the present invention from a memory to the apparatus. The program and its related data are supplied by inserting a storage medium 171 such as a floppy disk or a CD-ROM into an insertion port of a storage medium drive 173 provided in the apparatus 172. Thereafter, the program and its related data may be installed from the storage medium 171 into a hard disk and then loaded into a RAM, or alternatively, the program and its related data may be directly loaded into the RAM without being installed into a hard disk, to thereby enable the program and its related data to be executed.

When a program is to be executed by an image forming apparatus according to various embodiments of the present invention, the program and related data may be supplied to the image forming apparatus in the manner as shown in FIG. 18, or the program and related data may be stored in advance in the image forming apparatus, so that the program can be executed.

Figure 17:
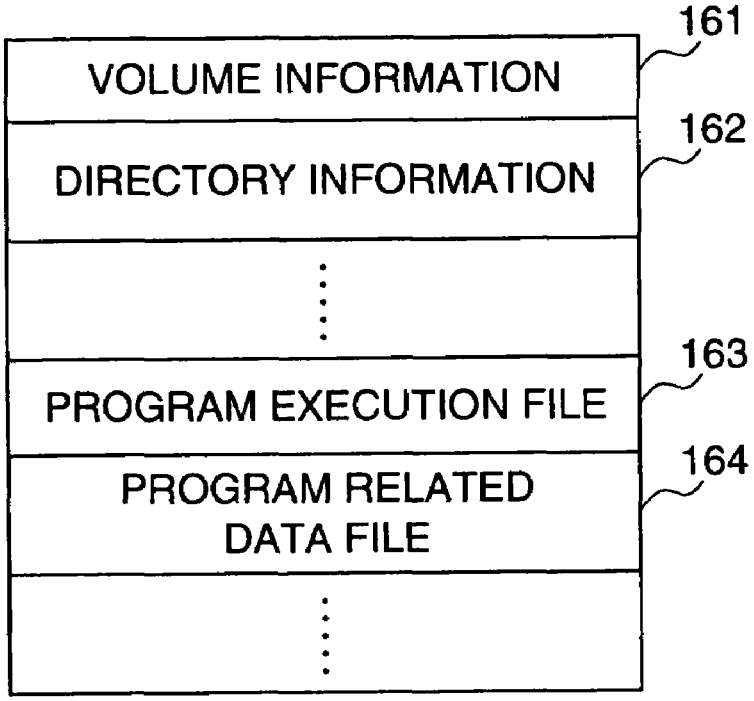
FIG. 17 is a view useful in explaining an exemplary construction of the contents stored in a storage medium storing a program for implementing the image forming control method according to the present invention and its related.

FIG. 17 is a view useful in explaining an exemplary construction of the contents stored in a storage medium storing a program for implementing the image forming control method according to the present invention and its related. The storage medium contains volume information 161, directory information 162, a program execution file 163, a program related data file 164, etc. The program code is based on flow charts, described later.

Next, operations using the sheet type setting executed by the image forming apparatus according to the first embodiment constructed as above will be described in detail with reference to flow charts in FIGS. 6 to 10. Processes for these operations are executed by the CPU circuit 122 of the image forming apparatus by reading and executing the program stored in the ROM 125.

Figure 6:
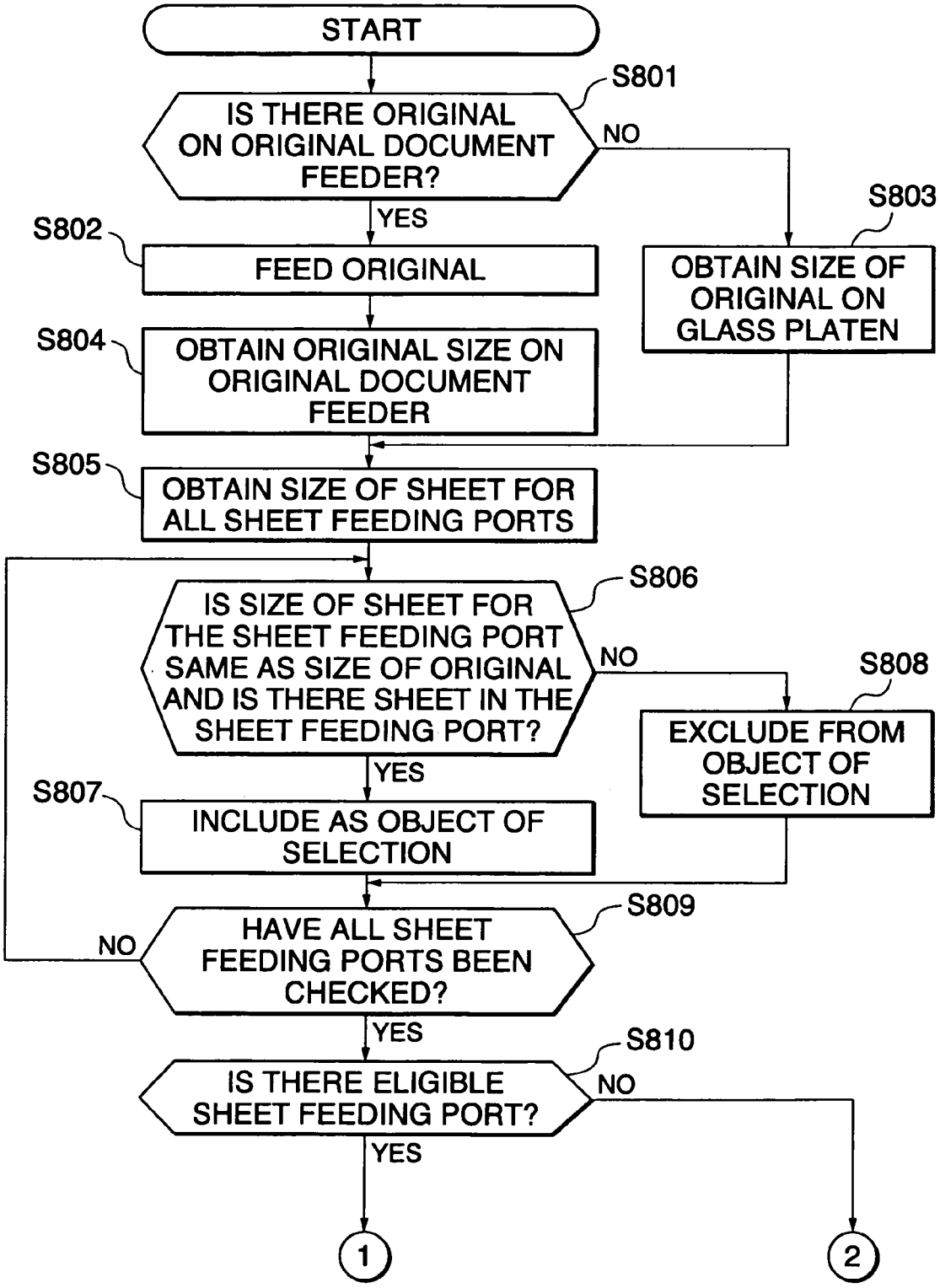
FIG. 6 is a flow chart showing a sheet feeding port selecting process executed by the image forming apparatus according to the first embodiment.
Figure 7:
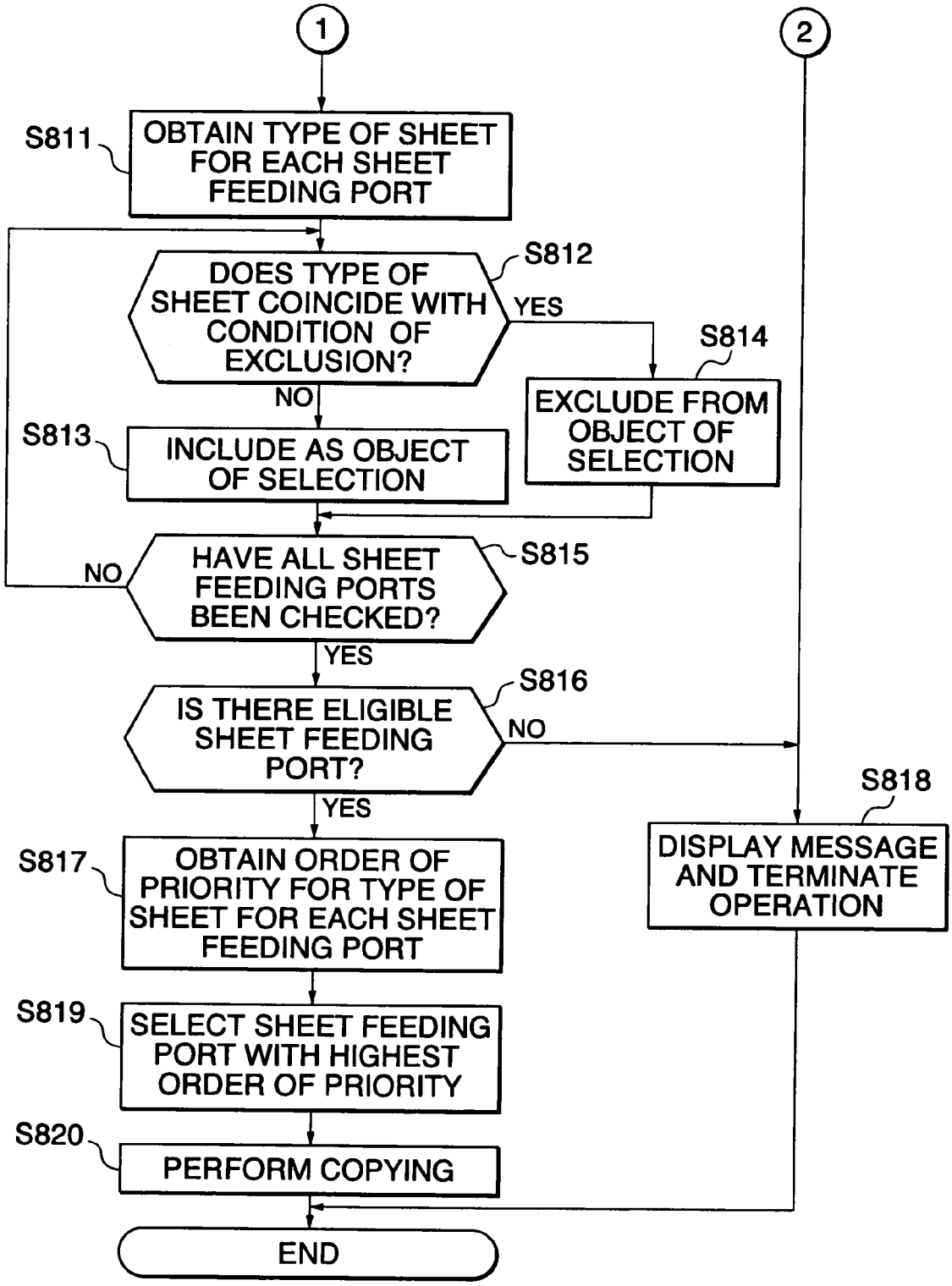
FIG. 7 is a flow chart showing a sheet feeding port selecting process executed by the image forming apparatus according to the first embodiment.

First, the selection of sheet feeding port will be explained with reference to FIGS. 6 and 7. First, using an original size sensor 130 provided on an original tray of the original document feeder 101 in FIG. 2, it is determined whether an original is present on the original tray of the original document feeder 101 or not (step S801). If there is no original on the original tray of the original document feeder 101, the size of an original on the glass platen 102 detected by an original size sensor 127 located below the glass platen is referred to (step S803). If there is an original on the original document feeder 101, the original is fed onto the glass platen 102 by the original document feeder 101 (step S802), and the size of the original is detected based on a result of detection of the position of an original guide 135 in the width direction and a result of detection of the length of the original made by a sensor 140 when the original is conveyed to the glass platen 102 (step S804). When, for example, the width of the original guide 135 is 297 mm and the length of the original being conveyed is 210 mm, the original is detected to be of A4 size.

Data on the size of the original may be obtained from an input operation by the user through the operating section 123.

Next, the optimum sheet for the A4 size original is selected. Since the sheet size feeding ports 1 to 4 are B4, A4, A4, and A4, respectively, the sheet feeding ports 2, 3, and 4 where sheets of the size corresponding to the size of the input original image are stored, are selectable as ports (candidates) for the automatic sheet selection, i.e. ports selectable for sheet feeding (step S805). It is checked whether or not any sheet is present in each of these sheet feeding ports (step S806). Presence of sheet(s) in each sheet feeding port is detected by a sensor, not shown. Since a sheet or sheets are present in every sheet feeding port in the instant case, all the sheet feeding ports are determined to be selectable as ports for sheet feeding (step S807). Any sheet feeding port in which there is no sheet is excluded from ports selectable for sheet feeding (step S808). If there is no sheet feeding port determined to be selectable as a port for sheet feeding port, "No optimum size" is displayed on the operating section 123 and the present operation is terminated (step S818).

Next, the sheet type is checked as to the sheet feeding ports 2, 3, and 4. In the instant case, the sheet type is colored paper in the sheet feeding port 2, recycled paper in the sheet feeding port 3, and ordinary paper in the sheet feeding port 4 (step S811). Then, it is determined whether the sheet type of each sheet feeding port satisfies a predetermined condition for exclusion (step S812). In the instant case, the predetermined condition for exclusion is that OHP paper, mother print paper, and thick paper be excluded from papers selectable for sheet feeding. In the instant case, the sheet type of any of the sheet feeding ports does not satisfy this condition. Thus, all the three sheet feeding ports are determined to be selectable as ports for sheet feeding (step S813).

If the sheet type of any sheet feeding port satisfies the above condition for exclusion, the sheet feeding port is excluded from the ports selectable for sheet feeding (step S814). If there is no sheet feeding port selectable as a port for the automatic sheet selection, "No optimum size" is displayed on the operating section 123 and the present operation is terminated (step S818).

Thus, in the instant case, the sheet feeding ports 2, 3, and 4 are selectable as ports for sheet feeding. Next, the order of priority that has been set for the sheet type of each of the sheet feeding ports selected as ports for sheet feeding is checked (step S817). As noted above, the order of priority is 3 for the colored paper in the sheet feeding port 2, 2 for the recycled paper in the sheet feeding port 3, and 1 for the ordinary paper in the sheet feeding port 4. Therefore, the sheet feeding port 4 with the highest order of priority is selected as the optimum sheet feeding port (step S819), and a copying operation is started using the sheet from this sheet feeding port 4 (step S820).

Figure 8:
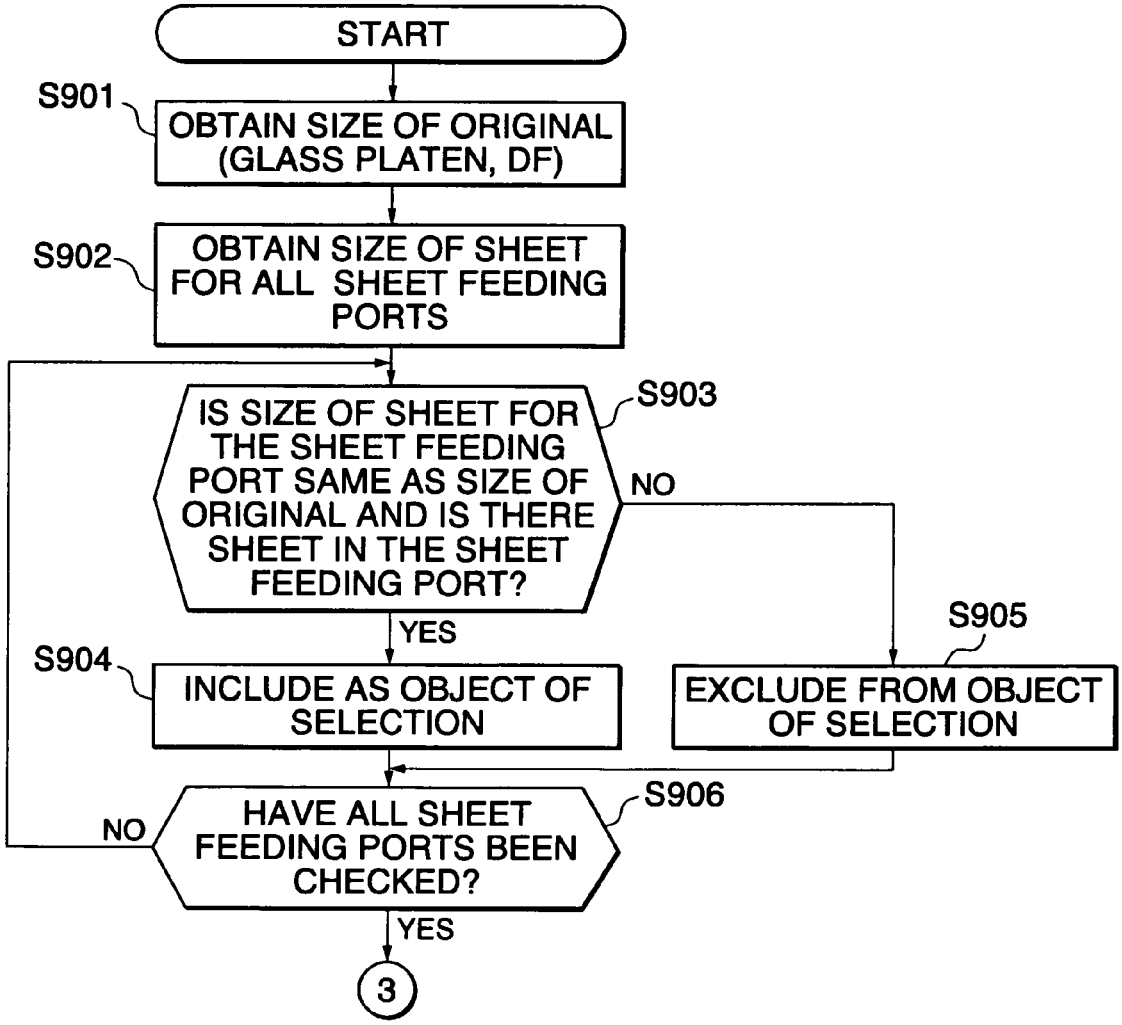
FIG. 8 is a flow chart showing a sheet feeding port selecting process executed upon automatic cassette change due to sheet depletion by the image forming apparatus according to the first embodiment.
Figure 9:
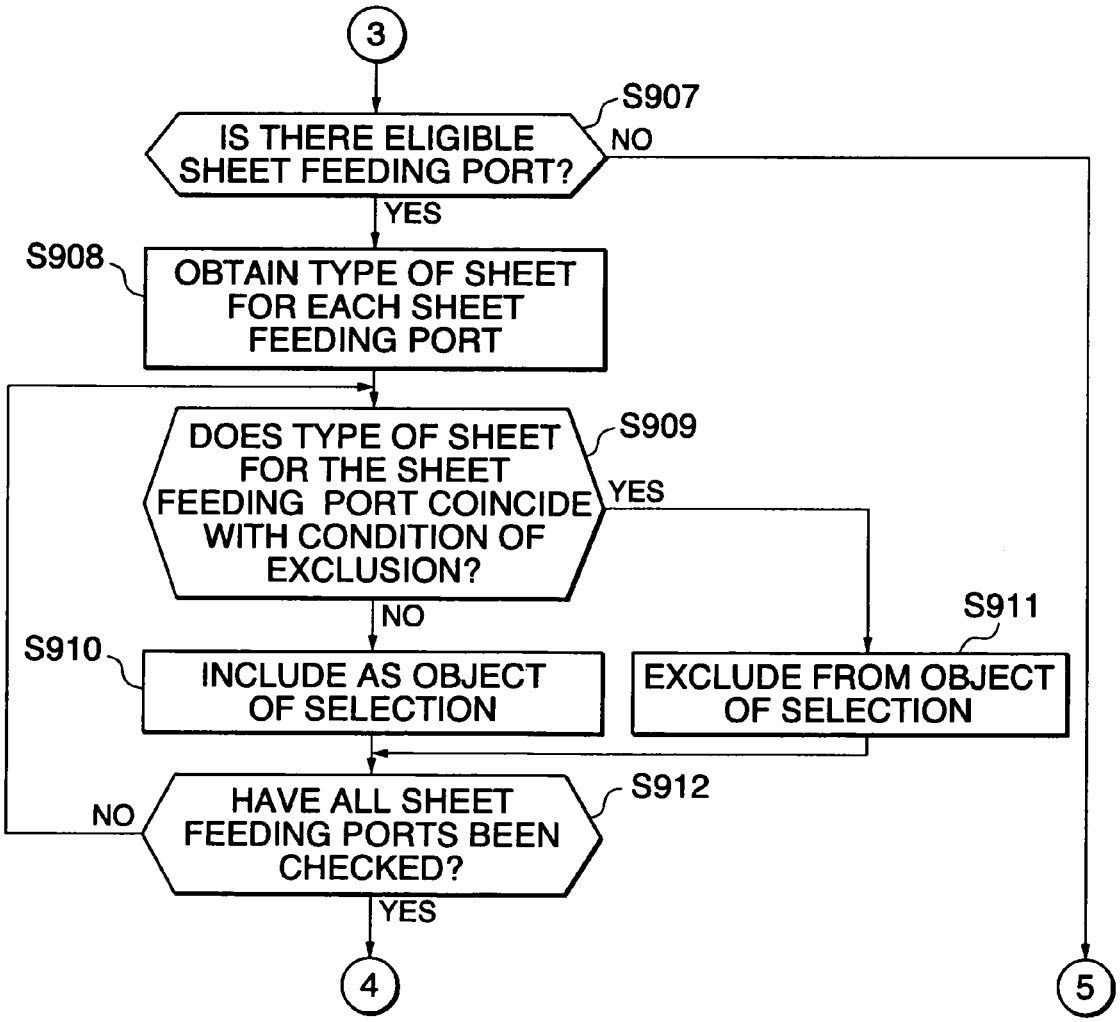
FIG. 9 is a flow chart showing a continued part of the sheet feeding port selecting process of FIG. 8.
Figure 10:
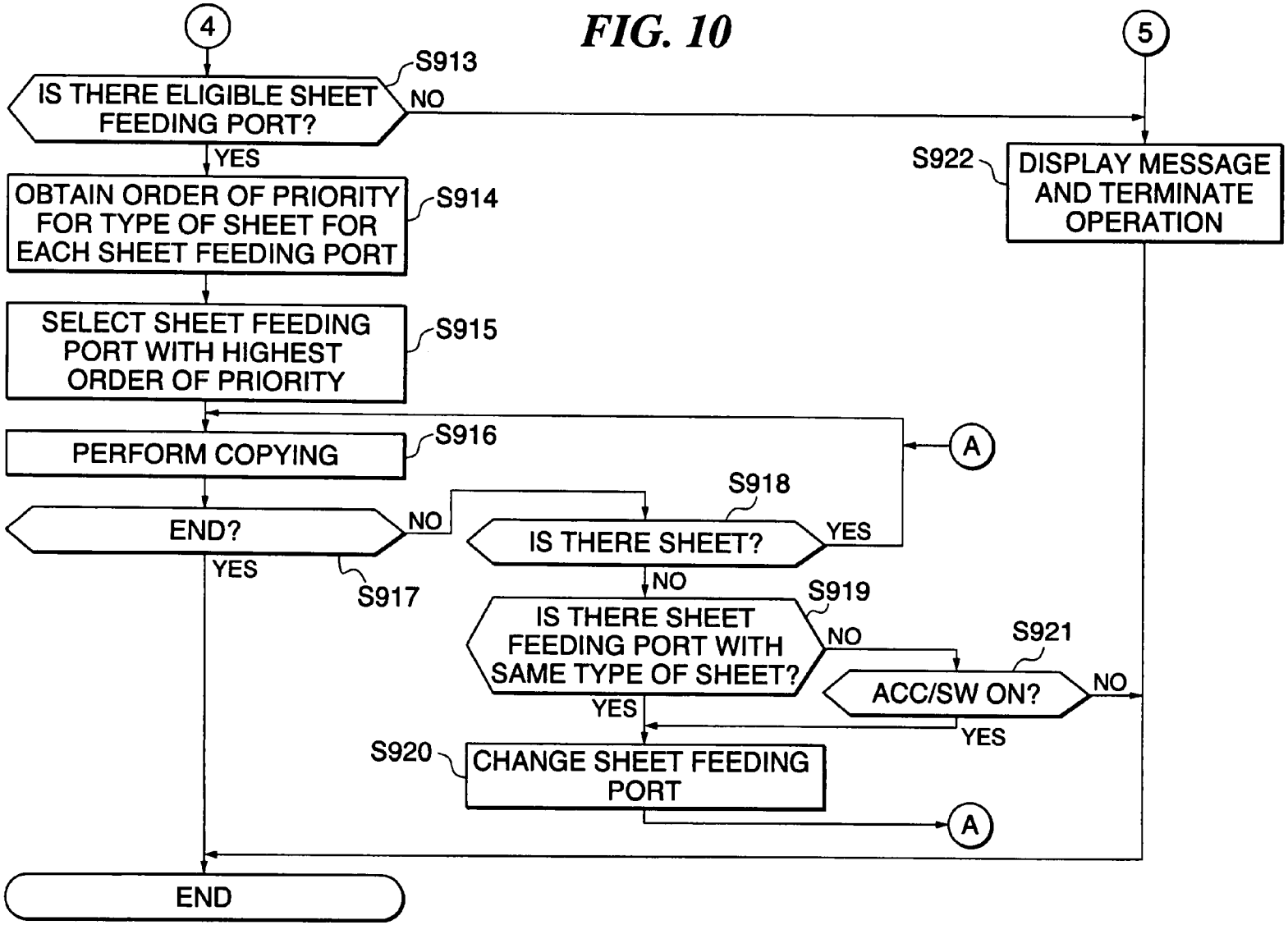
FIG. 10 is a flow chart showing a further continued part of the sheet feeding port selecting process of FIG. 8.

Next, a manner of automatically switching the sheet feeding port when the sheet feeding port selected as optimum has run short of sheets will be described with reference to FIGS. 8 to 10. Let it be assumed, in the instant case, that sheets of B4 size, A4 size, A4 size, and A4 size are stacked in the sheet feeding ports 1, 2, 3, and 4, respectively. It is further assumed that the sheet type has been set to "ordinary paper" for the sheet feeding port 1, "colored paper" for the sheet feeding port 2, "ordinary paper" for the sheet feeding port 3, and "ordinary paper" for the sheet feeding port 4, by the operating section 123. It is further assumed that an original of A4 size is to be copied on 100 sheets and that 100 sheets, 20 sheets and 50 sheets are stored in the sheet feeding ports 2, 3, and 4, respectively, at the start of the copying operation.

First, it is determined using the original sensor 130, not shown, provided on the original tray of the original document feeder 101 whether there is an original on the tray or not. If there is no original on the original tray, the size of an original on the glass platen 102 detected by the original size sensor 127 arranged below the glass platen 102 is referred to. If there is an original on the original tray of the original document feeder 101, the size of the original is detected based on the width of the original guide and the length of the original detected when the original is conveyed to the glass platen 102. In the instant case, since the width of the original is 297 mm and the conveyance length is 210 mm, the original is detected to be of A4 size (step S901).

Next, the optimum sheet (that is, the optimum sheet feeding port) for the original of A4 size is selected (step S902). Since the sheet sizes in the sheet feeding ports 1, 2, 3, and 4 are B4, A4, A4, and A4, respectively, the sheet feeding ports 2, 3, and 4 are selectable as ports for the automatic sheet selection, i.e. ports for sheet feeding. It is then checked whether any sheet or sheets are actually present in each of the sheet feeding ports (step S903). In the instant case, all of the sheet feeding ports 2, 3, and 4 are determined to be selectable as ports for sheet feeding since there are sheets in these ports (step S904). If there is no sheet in any sheet feeding port, the port is excluded from ports selectable for sheet feeding (step S905). Then, it is determined whether the checking at the step S903 has been completed as to all the sheet feeding ports (step S906). If it has been completed, it is determined whether there is any sheet feeding port that has been determined as a port selectable for sheet feeding (step S907). When there is no sheet feeding port that has been determined as a port selectable for sheet feeding, "No optimum size" is displayed on the operating section 123 and the present operation is terminated (step S922).

Next, the sheet type is checked as to the sheet feeding ports 2, 3, and 4 (step S908). In the instant case, the sheet type is "recycled paper" for the sheet feeding port 2, "ordinary paper" for the sheet feeding port 3, and "ordinary paper" for the sheet feeding port 4. Then, it is determined whether the sheet type for each sheet feeding port satisfies a predetermined condition for exclusion (step S909). In the instant case, the predetermined condition for exclusion is that OHP paper, mother print paper, and thick paper be excluded from papers selectable for sheet feeding, and the sheet type of any of the sheet feeding ports does not satisfy this condition. Thus, all the three sheet feeding ports are determined to be selectable as ports for sheet feeding. in any sheet feeding port satisfies the above condition for exclusion, the sheet feeding port is excluded from the ports selectable for sheet feeding (step S911). Then, it is determined whether the checking of the condition for exclusion at the step S909 has been completed for all the sheet feeding ports (step S912), and if it has been completed, it is determined whether there is any sheet feeding port which is selectable as a port for sheet feeding (step S913). If there is no sheet feeding port selectable as a port for sheet feeding, "No optimum size" is displayed on the operating section 123 (step S922).

Thus, all the three sheet feeding ports, 2, 3, and 4, are determined to be selectable as ports for sheet feeding. Next, that has been set for the sheet type of each of the sheet feeding ports selected as ports for sheet feeding is checked (step S914). The order of priority is 3 for the colored paper in the sheet feeding port 2, 1 for the ordinary paper in the sheet feeding port 3, and 1 for the ordinary paper in the sheet feeding port 4. The order of priority is the highest for the sheet feeding ports 3 and 4. Since the conveyance path for the sheet feeding port 3 is shorter than that for the sheet feeding port 4 (that is, the sheet feeding port 3 is nearer to the image forming section), as shown in FIG. 2, the sheet feeding port 3 is selected as optimum in terms of productivity (step S915), and copying is started using sheets from this port. At the same time, the CPU circuit 122 stores in the RAM 126 information indicating that the sheet feeding port 3, the sheet size of A4 and the sheet type of ordinary paper should be used.

Then, copying is carried out using sheets fed from the sheet feeding port 3 until 20 sheets are output. When 20 sheets have been output, the sheet feeding port has run short of sheets (the answer to the question of a step S918 is YES), and then another sheet feeding port is searched for sheet feeding (step S919). Sheets of A4 size are stored in the sheet feeding ports 2 and 4, the sheet type being colored paper for the sheet feeding port 2 and ordinary paper for the sheet feeding port 4. Since the types of sheets being fed is ordinary paper (step S919), the sheet feeding port 4 is selected and sheet feeding is continued (step S920), although the sheet feeding port 2 is nearer to the image forming section. When 50 sheets have been output, the sheet feeding port 4 has also run short of sheets.

The remaining sheet feeding port which can feed sheets of A4 size is the sheet feeding port 2. The type of sheets being fed is ordinary paper and is not the same with the sheet type for the sheet feeding port 2. Therefore, the status of the switch "Automatic cassette change to different sheet type (ACC)" set by the operating section 123 is checked (step S921). If this switch is on, the sheet feeding port is switched to the sheet feeding port 2 and sheet feeding is continued (step S920). If the switch is off, the sheet feeding operation is stopped and a message indicating the sheet exhaustion is displayed on the operating section 123.

In this way, in the case where while image formation is being performed using sheets of a certain type and size, sheet exhaustion arises (or, already at the start of image formation, sheets of a certain type and a certain size are not present), candidate sheets of a different type but of the same size, which are present, may be used to continue (or start) the image forming operation, provided that there is no problem in image formation if the candidate sheet is used (that is, there arises no trouble such as a missing image or image part in the output result or reduction in the image size against an instruction by the user, etc.). To reflect the user's intention as to whether such an alternative sheet outputting process should be performed or not, the CPU of the CPU circuit 122 checks the set status of above-mentioned switch, and, depending upon the result of this checking, controls the operation so as to inhibit or permit the above described process.

As described above, the image forming apparatus according to the first embodiment of the present invention is comprised of the reader section 1 that scans the original and converts it into image data, the printer section 2 that prints characters on sheets based on the image data, and a plurality of sheet feeding ports 214, 215, 225, and 226 for storing and feeding sheets, the apparatus being characterized by being further comprised of the original size sensor 127 for detecting the size of the original, the operating section 123 that inputs types of sheets to be fed by the sheet feeding ports, and the CPU 122 that selects a sheet feeding port which can feed desired sheets, from among the plurality of sheet feeding ports, based upon the size of the original detected by the original size sensor 127 and the sheet type input by the operating section 123. With the apparatus thus constructed, by setting the sheet type beforehand, it is possible to achieve a sheet feeding operation in a manner better meeting the user's desire than with the conventional functions, in automatic selection of sheets and automatic cassette change in the event of sheet exhaustion. Further, it is possible to overcome the disadvantage with the prior art that automatic sheet selection had to be set again for each mode depending on the copy mode. Thus, the user can perform a copying operation with the automatic sheet selection function without worrying about the copy mode.

[Second Embodiment]

An image forming apparatus according to a second embodiment of the present invention will now be described. Similarly to the above described first embodiment, as shown in FIG. 2, the image forming apparatus according to the second embodiment is comprised of a reader section 1, a printer section 2, a sorter section 230, and a punching unit 250. The reader section 1 is comprised of an original document feeder 101, an glass platen 102, a scanner unit 104 including a lamp 103 and a mirror 105, a mirror 106, a mirror 107, a lens 108, and a CCD 109. The printer section 2 is comprised of an exposure controller 201, a polygon mirror 207, a photosensitive drum 211, a developing unit 212, a transfer unit 216, a fixing unit 217, a sheet discharging unit 218, a discharging roller 219, a conveyance direction switching member 220, a refeeding sheet stacking unit 221, sheet stacking units 214, 215, 225, and 226. The sorter section 230 includes bins 241, 242 and others (see FIG. 2 above). Details of these components have been described above, and further description thereof is therefore omitted.

The reader section 1 of the image forming apparatus according to the second embodiment is constructed similarly to the above-described first embodiment, that is, as shown in FIG. 1, it is comprised of a CCD 109, amplifiers 110R, 110G, and 110B, an A/D converter 111, a shading circuit 112, a Y-signal generation/color detection circuit 113, a variable power/repeat circuit 114, a profile/edge enhancing circuit 115, a marker area determination/profile generation circuit 116, a patterning/thickening/masking/trimming circuit 117, an image selector circuit 118, a laser driver circuit 119, an image memory 120, a connector 121, a CPU circuit 122 including a ROM 125 and a RAM 126, an operating section 123, an image data reduction circuit 124 and an original size sensor 127 (see FIG. 1 above). Since details of these components have been described above, further description thereof is therefore omitted.

Figure 11:
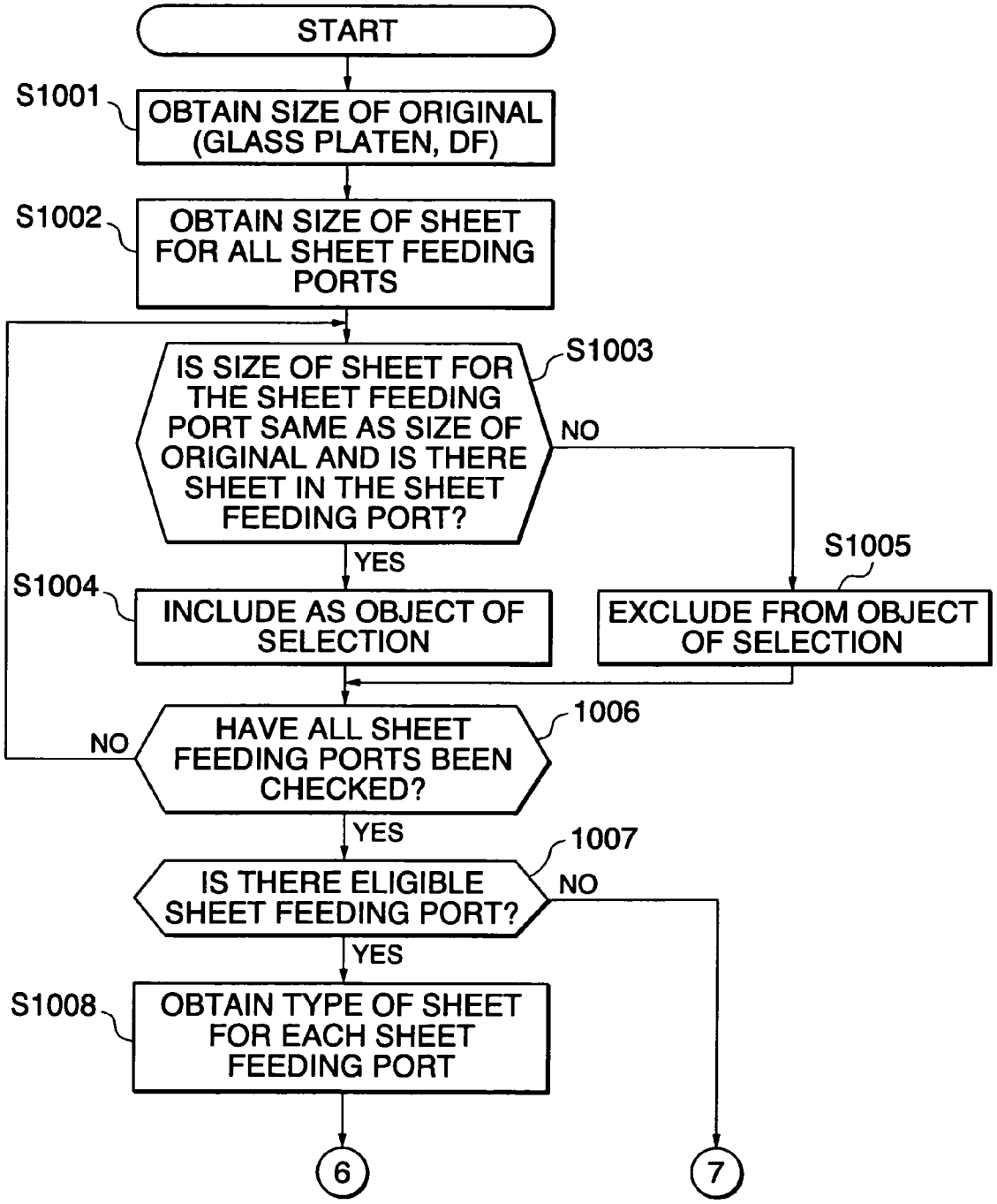
FIG. 11 is a flow chart showing a sheet feeding port selecting process executed upon punching operation by the image forming apparatus according to a second embodiment of the present invention.
Figure 12:
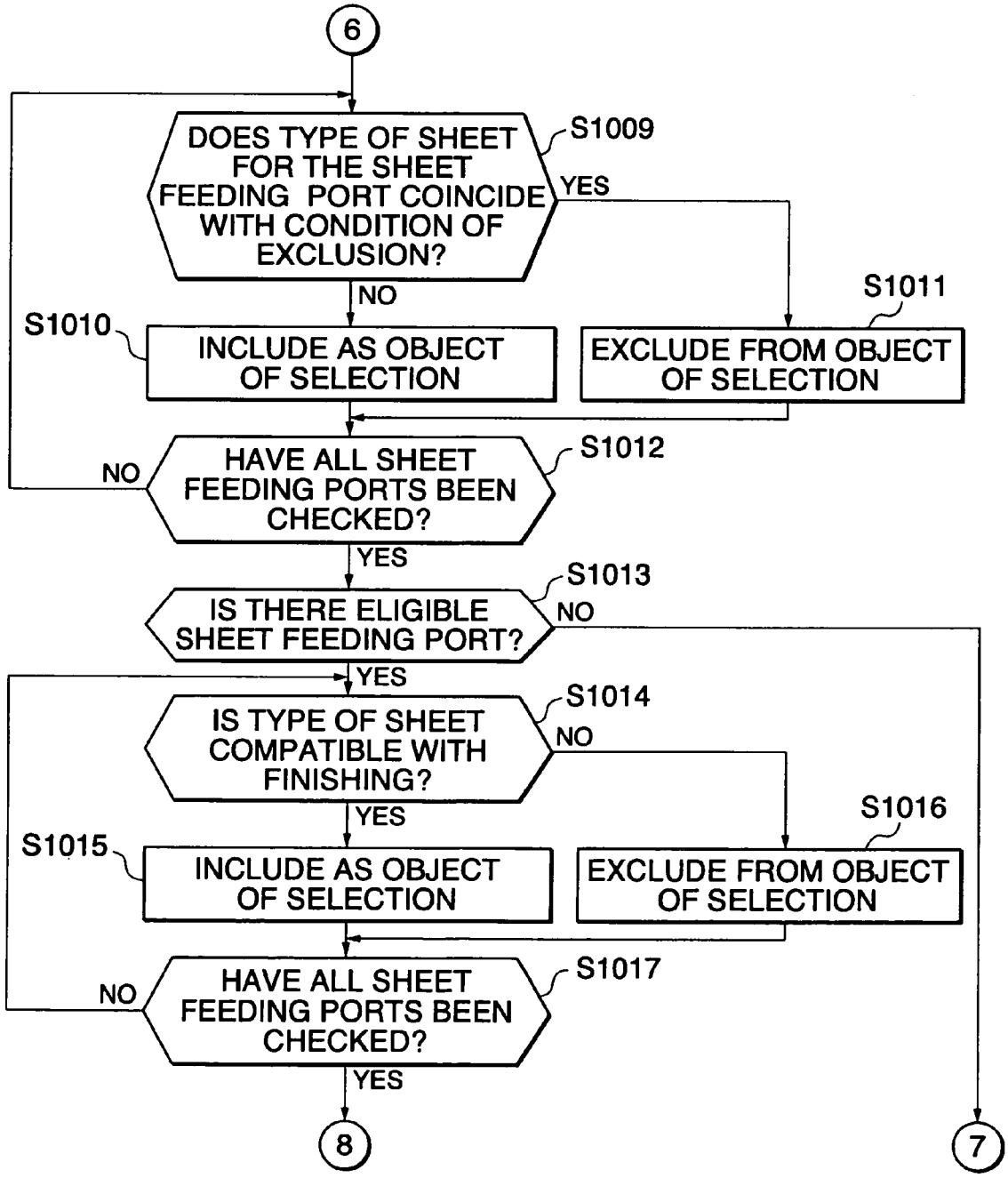
FIG. 12 is a flow chart showing a continued part of the sheet feeding port selecting process of FIG. 11.
Figure 13:
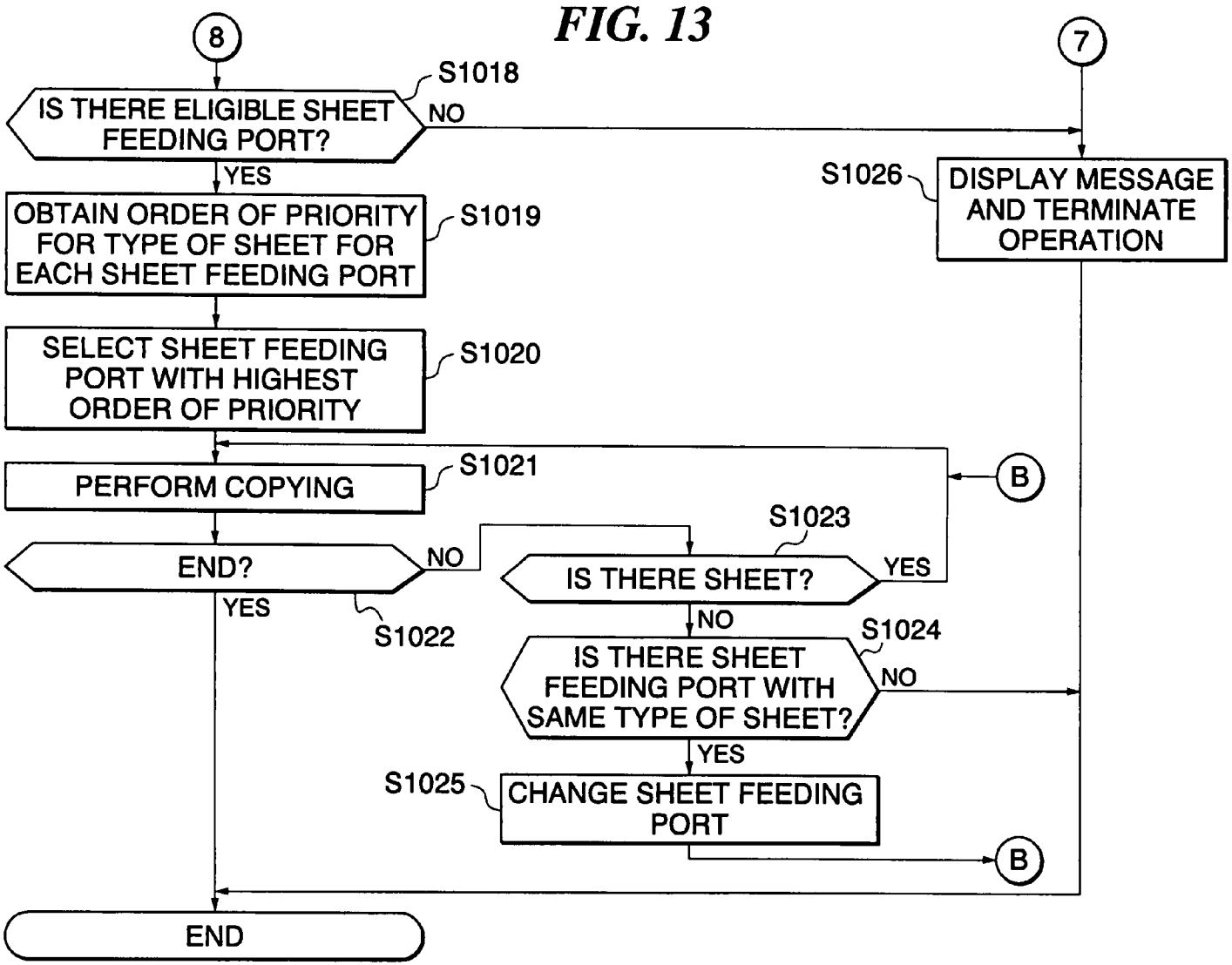
FIG. 13 is a flow chart showing a further continued part of the sheet feeding port selecting process of FIG. 11.

Next, with reference to FIGS. 11 to 13, the operation of the image forming apparatus will be described taking for example the case where a sheet processing apparatus having a staple function or an apparatus having a punching function (the punching unit 250 in FIG. 2 , referred to above) is connected to the image forming apparatus. As regards the sheet size for each sheet feeding port, it is assumed that sheets of B4 size, A4 size, A4 size, and A4 size are stacked in the sheet feeding ports 1, 2, 3, and 4, respectively. Let it be assumed that the sheet type of each sheet feeding port has been set to "ordinary paper" for the sheet feeding port 1, "prepunched paper" for the sheet feeding port 2, "ordinary paper" for the sheet feeding port 3, and "ordinary paper" for the sheet feeding port 4, by the operating section 123. Let it be further assumed that an original of A4 size is to be copied on 100 sheets and a punching process has been set at the operating section 123.

First, it is determined using the original sensor, not shown, provided on the original tray of the original document feeder 101 whether there is an original on the tray or not. If there is no original on the original tray, the size of the original detected by the original size sensor 127 below the glass platen is referred to. If there is an original on the original tray of the original document feeder 101, the original is fed onto the glass platen 102 by the original document feeder 101, and the size of the original is detected based on the width of the original guide and the length of the original detected when the original is conveyed to the glass platen 102. Since, in the instant case, the width of the original guide is 297 mm and the length of the original being conveyed is 210 mm, the original is detected to be of A4 size (step S1001).

Next, the optimum sheet for the original of A4 size is selected. Since the sheet sizes in the sheet feeding ports 1, 2, 3, and 4 is B4, A4, A4, and A4, respectively (step S1002), the sheet feeding ports 2, 3, and 4 are determined to be selectable as ports for the automatic sheet selection, i.e. ports selectable for sheet feeding. It is then checked whether a sheet or sheets are actually present in any of the sheet feeding ports (step S1003). All of the sheet feeding ports 2, 3, and 4 are determined to be the selectable ports since there are sheets in these ports (step S1004). If there is no sheet in any of the sheet feeding ports, the port is excluded from ports selectable for sheet feeding (step S1005). Then, it is determined whether the checking at the step S1003 has been completed or not as to all the sheet feeding ports (step S1006), and if the checking has been completed, it is determined whether there is any sheet feeding port that can be selected for sheet feeding (step S1007). If there is no such sheet feeding port, "No optimum size" is displayed on the operating section 123 and the present operation is terminated (step S1026).

Next, the sheet type is checked for the sheet feeding ports 2, 3, and 4 (step S1008). In the instant case, the sheet type is "prepunched paper" for the sheet feeding port 2, "ordinary paper" for the sheet feeding port 3, and "ordinary paper" for the sheet feeding port 4. Then, it is determined whether the sheet type for each sheet feeding port satisfies a predetermined condition for exclusion (step S1009). In the instant case, the predetermined condition for exclusion is that OHP paper, mother print paper, and thick paper be excluded from papers selectable for sheet feeding, and the sheet types in all of the sheet feeding ports do not satisfy this condition so that all the sheet feeding ports are determined to be selectable for sheet feeding (step S 1010). If the sheet type of any of the sheet feeding ports satisfies the above condition of exclusion, the sheet feeding port is excluded from ports selectable for sheet feeding (step S911). Then, it is determined whether the checking at the step S1009 has been completed as to all the sheet feeding ports (step S1012). If it has been completed, it is determined whether there is any sheet feeding port that has been determined as a port selectable for sheet feeding (step S1013). If there is no sheet feeding port selectable as a port for sheet feeding, "No optimum size" is displayed on the operating section 123, and the present operation is terminated (step S1026). Since the punching process has been set in the instant case (the answer to the question of a step S1014 is NO), the sheet feeding port 2 is excluded from ports selectable for sheet feeding since the prepunched paper has punched holes (step S1016).

Thus, the sheet feeding ports 3 and 4 are determined to be ports selectable for sheet feeding. Then, it is determined whether the determination at the step S1014 has been completed or not as to all the sheet feeding ports (step S1017). If the determination has been completed, it is determined whether there is any sheet feeding port selectable for sheet feeding (step S1018). If there is no such sheet feeding port, "No optimum size" is displayed on the operating section 123, and the present operation is terminated (step S1026). Next, the order of priority that has been set for the sheet type of each sheet feeding port determined as a port selectable for sheet feeding is checked (step S1019). The order of priority is 1 for the ordinary paper in the sheet feeding port 3, and 1 for the ordinary paper in the sheet feeding port 4. The order of priority is the highest for the sheet feeding ports 3 and 4. Since the conveyance path for the sheet feeding port 3 is shorter than that for the sheet feeding port 4, as shown in FIG. 2, the sheet feeding port 3 is selected as the optimum sheet feeding port in terms of productivity (step S1020), and copying is started (step S1021). At the same time, the CPU circuit 122 stores in the RAM 126 information indicating that the sheet feeding port 3, the sheet size of A4 and the sheet type of ordinary paper should be used.

Then, copying is carried out using sheets fed from the sheet feeding port 3 until 20 sheets are output. When 20 sheets have been output, the sheet feeding port has run short of sheets (the answer to the question of a step S1023 is NO), and then another sheet feeding port is searched for sheet feeding (step S1024). Sheets of A4 size are stored in the sheet feeding port 4, the sheet type being ordinary paper for the sheet feeding port 4. Since the type of sheets being fed is ordinary paper, the sheet feeding port 4 is selected (step S1025) and sheet feeding is continued. When 50 sheets have been output, the sheet feeding port 4 has also run short of sheets.

The remaining sheet feeding port which can feed sheets of A4 size is the sheet feeding port 2. The type of sheets being fed is ordinary paper and is not the same with the sheet type for the sheet feeding port 2. Since the sheet type of the sheet feeding port 2 is prepunched paper, and the current operation mode is a mode for punching sheets, the status of the switch "Automatic cassette change to different sheet type(ACC)" set by the operating section 123 is not checked, and a message indicating the sheet exhaustion is displayed on the operating section 123.

In this way, in the case where while image formation is being performed using sheets of a certain type and a certain size (in the instant case, ordinary paper of A4 size), if sheet exhaustion arises (or, already at the start of image formation, sheets of a certain type and a certain size are not present) and sheets of a different type, but of the same size are then present as a candidate of alternative sheets, depending on the type of the candidate sheets (in the instant case, prepunched paper of A4 size) and the operation mode set by the user in the operating section (in the instant case, the punching process mode), the apparatus is controlled such that the alternative sheet outputting process as described above is inhibited irrespective of whether the alternative sheet outputting process has been set by the switch "automatic cassette change to different sheet type" or not.

In the above described embodiment, prepunched paper is excluded from papers selectable for sheet feeding in the case where the punching process mode has been set. However, the present invention is not limited to this case, and the apparatus may be controlled such that, for example, prepunched paper is excluded from papers selectable for sheet feeding when a staple process mode has been set as the operation mode by the user.

Alternatively, conversely to the above case, the present invention may be constructed such that in the case where "prepunched paper" has been set beforehand as the sheet type to be used with the highest priority, since prepunched paper has been already subjected to sheet processing, sheet processing such as a staple process and a punching process is inhibited and a corresponding function button on the operating screen view is invalidated and displayed in halftone dot meshing so that the user cannot select a mode for performing such sheet processing.

As described above, the image forming apparatus according to the second embodiment of the present invention is comprised of the reader section 1 that scans the original and converts it into image data, the printer section 2 that prints characters on sheets based on the image data, a plurality of sheet feeding ports 214, 215, 225, 226 for storing and feeding sheets, and a finisher (stapler, punching unit) for performing post-processing on the sheets having characters printed thereon, the apparatus being characterized by being further comprised of the original size sensor 127 that detects the size of the original, the operating section 123 for inputting sheet types for the sheet feeding ports, and the CPU circuit 122 that selects an optimum sheet feeding port from among the plurality of sheet feeding ports based on the original size detected by the original size sensor 127 and the sheet type input through the operating section 123. With the apparatus thus constructed, by setting the sheet type beforehand, as in the first embodiment, it is possible to achieve sheet feeding in a manner better meeting the user's desire than the conventional functions, in automatic selection of sheets or automatic cassette change in the event of sheet exhaustion. Further, it is possible to overcome the disadvantage with the prior art that automatic sheet selection had to be set again for each mode depending on the copy mode. Thus, the user can perform a copying operation with the automatic sheet selection function without worrying about the copy mode.

[Third Embodiment]

In the above-described first and second embodiments, a sheet feeding port is selected according to the order of priority for the sheet type set by the user. Alternatively to the order of priority, the apparatus may be constructed such that a specific sheet feeding port is selected. More specifically, for example, sheet feeding ports for feeding ordinary paper and recycled paper are grouped as a group 1, and sheet feeding ports for feeding colored paper and thick paper are grouped as a group 2, beforehand. When the user sets a mode in which any of ordinary paper, recycled paper, colored paper, and thick paper can be selected (Automatic sheet selection mode 1), through the operating section 123, sheet feeding ports belonging to the groups 1 and 2 are set to ports seletable for sheet feeding. When the user sets a mode in which only ordinary paper and recycled paper can be selected (Automatic sheet selection mode 2), sheet feeding ports belonging to the group 1 are set to ports selectable for sheet feeding. OHP paper,letterhead paper, mother print paper, prepunched paper, and label paper are classified as the sheet type that satisfies the condition of exclusion described with reference to the first and second embodiments, and are not selected in the automatic selection of sheet feeding port.

The image forming apparatus according to the third embodiment has the same hardware construction as that of the first embodiment, and therefore description thereof is omitted.

Figure 14:
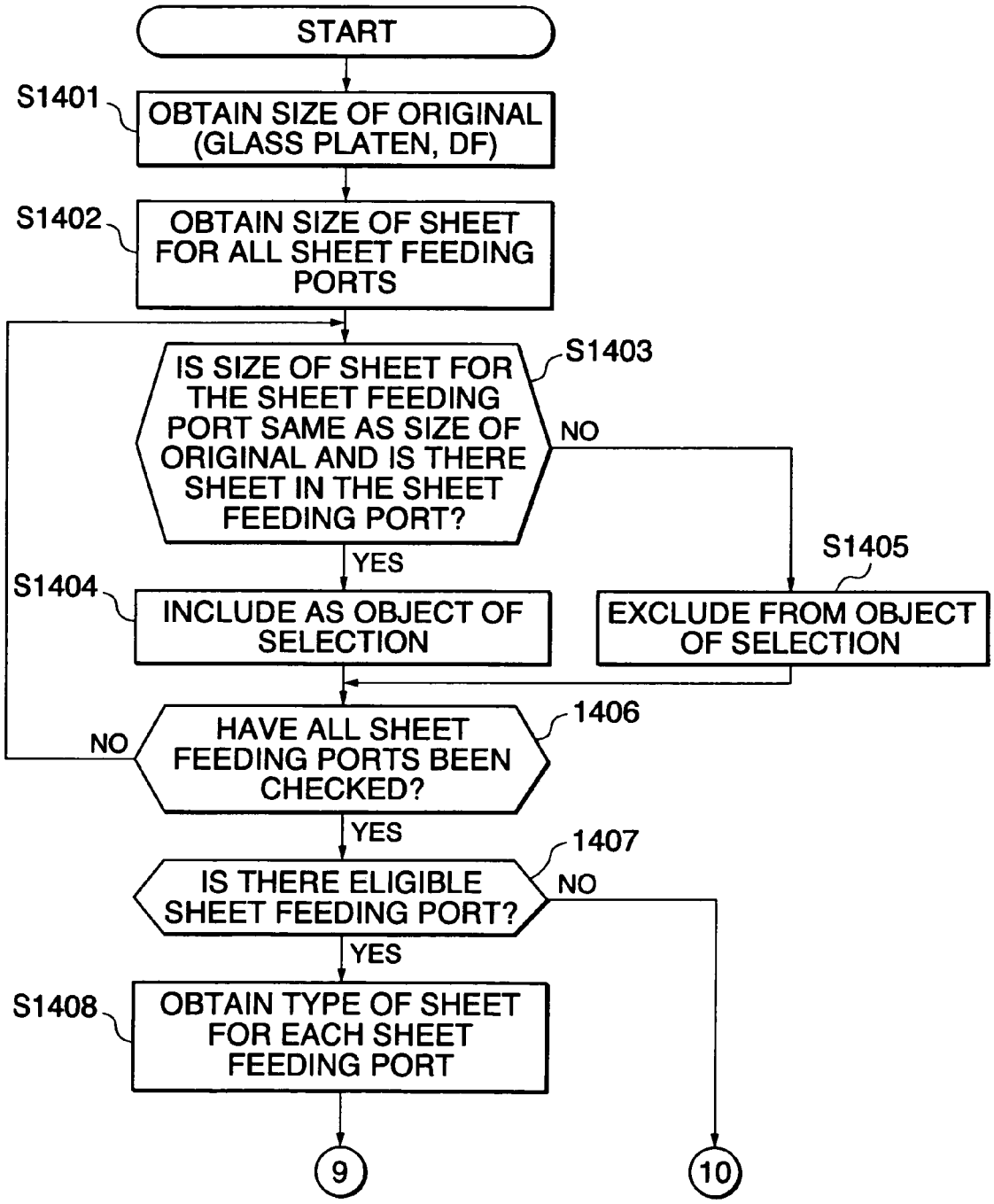
FIG. 14 is a view showing a sheet feeding port selecting process executed by the image forming apparatus according to a third embodiment of the present invention 1.
Figure 15:
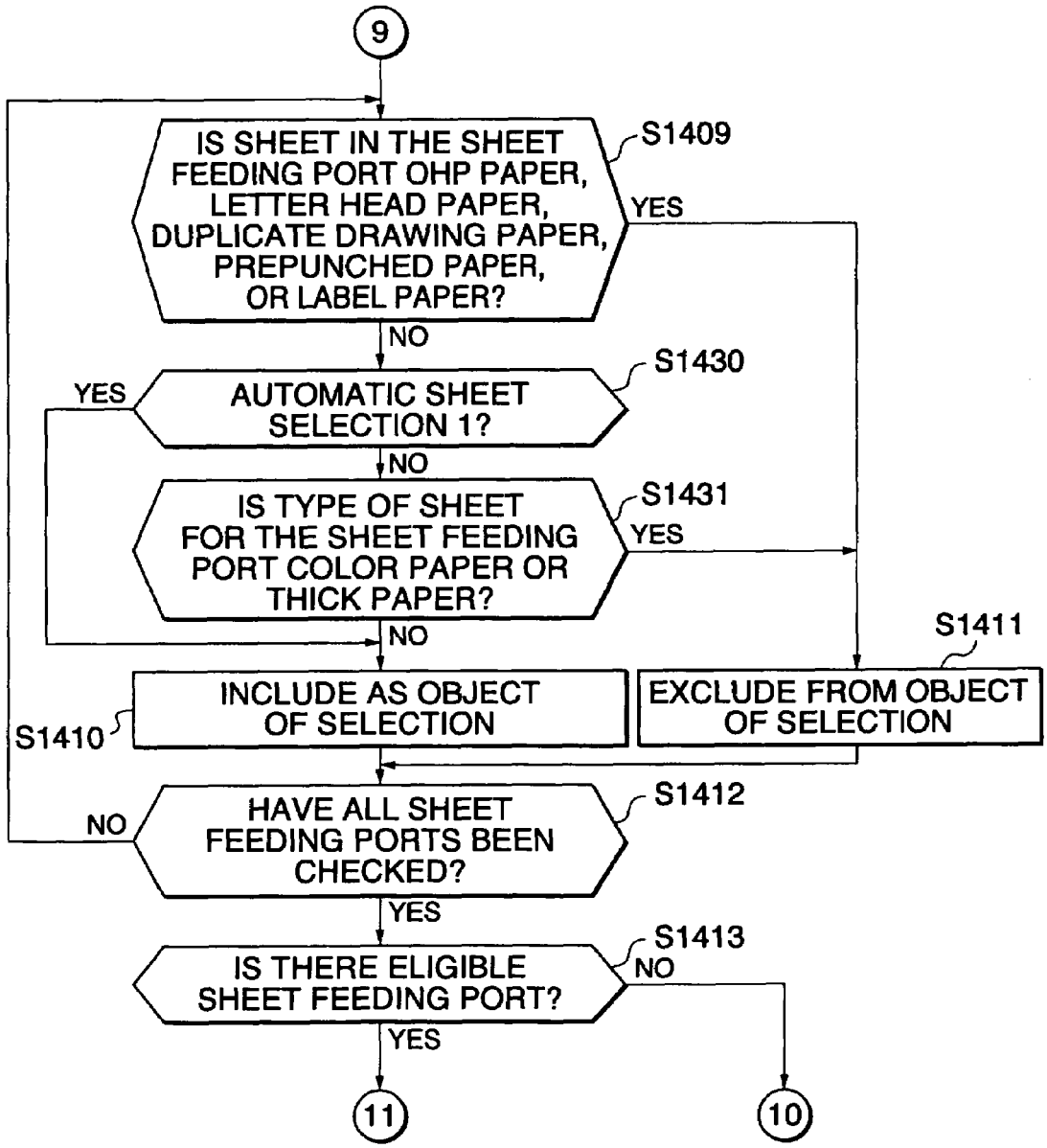
FIG. 15 is a flow chart showing a continued part of the sheet feeding port selecting process of FIG. 14.
Figure 16:
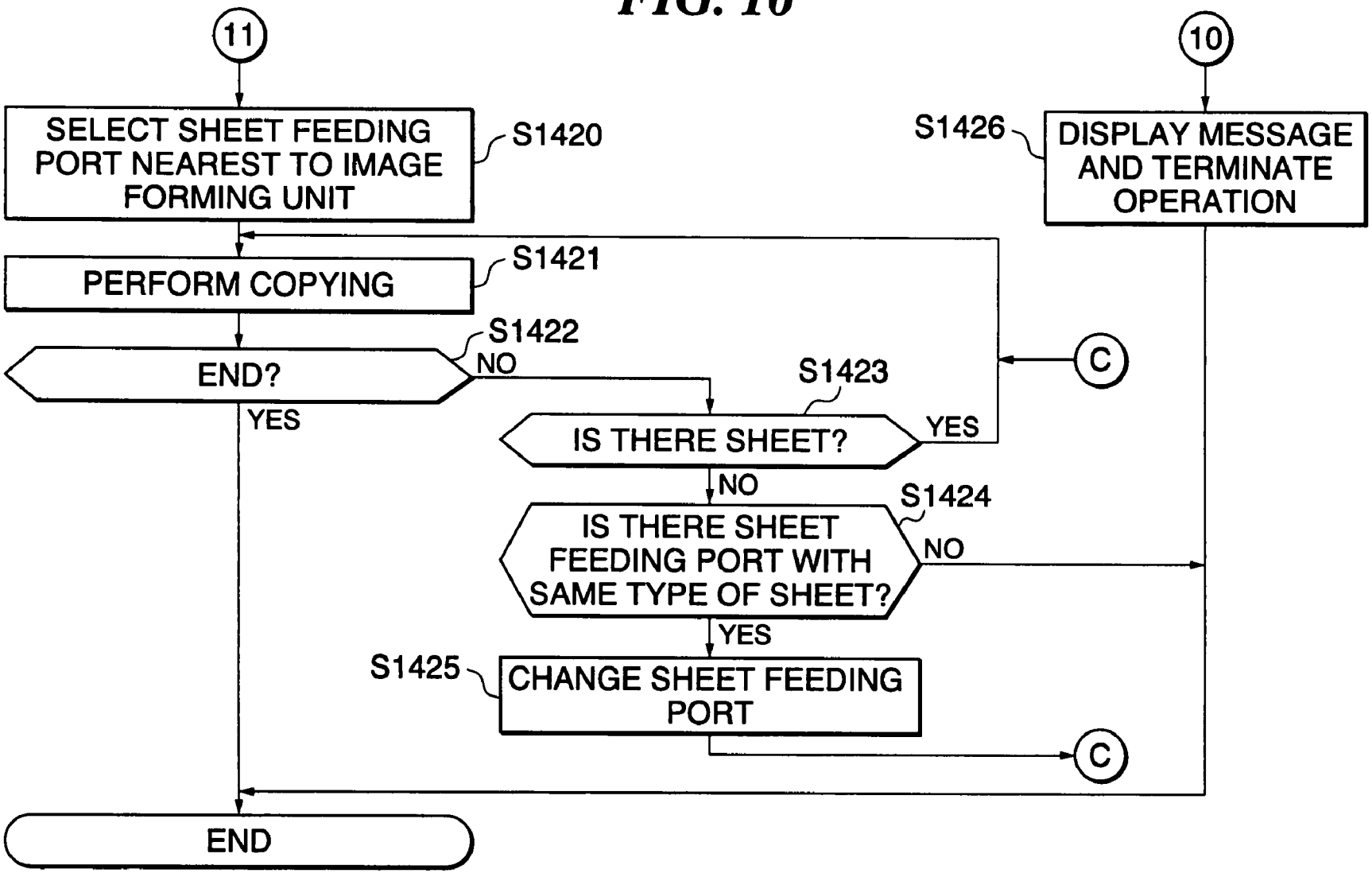
FIG. 16 is a flow chart showing a further continued part of the sheet feeding port selecting process of FIG. 14.

FIGS. 14 to 16 are flowcharts showing a sheet feeding port selecting process executed by the image forming apparatus according to the third embodiment. In the figures, steps S1401 to S1408 are identical with corresponding steps of the first and second embodiments, description of which is omitted. Based upon the sheet type obtained at the step S1408, it is determined which of OHP paper, letterhead paper, mother print paper, prepunched paper, and label paper the sheet type of the selectable sheet feeding port corresponds to (step S1409). If the answer is affirmative, the sheet feeding port is excluded from ports selectable for sheet feeding (step S1411), while if the answer is negative, it is determined whether the mode in which any of ordinary paper, recycled paper, colored paper, and thick paper can be selected (Automatic sheet selection mode 1) has been set (step S1430).

If the answer to the question of the step S1430 is negative, that is, if the mode in which ordinary paper and recycled paper alone can be selected (Automatic sheet selection mode 2) has been set, it is determined which of colored paper and thick paper the sheet type of the selectable sheet feeding port corresponds to (step S1431). If the answer to the question of the step S1431 is negative, that is, if the sheet type of the selectable sheet feeding port feeding is ordinary paper or recycled paper, the sheet feeding port is determined to be selectable for sheet feeding (step S1410).

If the answer to the question of the step S1430 is affirmative, that is, if the mode in which any of ordinary paper, recycled paper, colored paper, and thick paper can be selected (Automatic sheet selection mode 1) has been set, the process proceeds to the step S1410 to set the sheet feeding port in question to a port selectable for sheet feeding. If the answer to the question of the step S1431 is affirmative, that is, if the sheet type of the selectable sheet feeding port is ordinary paper or recycled paper, the process proceeds to the step S1411 to exclude the sheet feeding port in question from ports selectable for sheet feeding.

The above process is executed as to all the selectable sheet feeding ports (step S1412), and if there is no sheet feeding port selectable for sheet feeding (step S1413), a message display is carried out in the same manner as in the first and second embodiments by the operating section 123 (step S1426). If it is determined at the step S1413 that there is any sheet feeding port that has been determined as a port selectable for sheet feeding, one of the sheet feeding ports that have been determined as ports selectable for sheet feeding, that is the closest to the image forming section, i.e. the uppermost one of these sheet feeding ports is selected (step S1420), and copying is carried out by feeding sheets from the selected sheet feeding port (step S1421). Steps subsequent to the step S1421 are identical with corresponding ones of the second embodiment, and description thereof is therefore omitted.

[Other Embodiments]

In the above described first to third embodiments, ordinary paper, recycled paper, and colored paper are used as examples of the sheet type. However, the present invention is not limited to these exemplary sheet types.

In the above described second embodiment, when a punching operation is performed as a finishing process, prepunched paper is not selected as a paper for sheet feeding. The present invention is not limited to this. For example, when a stapling operation is performed as a finishing process, OHP paper and mother print paper which may give rise to a trouble may be excluded from papers for sheet feeding. That is, sheet type(s) which may give rise to a trouble in carrying out a finishing process is(are) may not be selected for sheet feeding.

In the above described first to third embodiments, an electrophotographic method is employed as the printing method. However, the present invention is by no means limited to this printing method, and other printing methods such as an ink jet printer may be used.

The above described first to third embodiments are applied to a single image forming apparatus. However, the present invention is not restricted to this example, but the present invention may also be applied to a system in which an image forming apparatus is connected to an information processing apparatus or the like.

The present invention may be applied either to a system composed of a plurality of apparatuses, or to a single apparatus. It is to be understood that the present invention may also be realized by supplying a system or an apparatus with a storage medium in which program code of software that realizes the functions of any of the above described embodiments is recorded, and causing a computer (or CPU, MPU) of the system or apparatus to read out and execute the program code stored in the storage medium.

In this case, the program code itself read out from the storage medium realizes the functions of any of the above described embodiments, so that the storage medium storing the program code also constitutes the present invention. The storage medium for supplying the program code may be selected, for example, from a floppy disk, hard disk, optical disk, magneto-optical disk, CD-ROM, CD-R, magnetic tape, non-volatile memory card, ROM, or the program code may be obtained by downloading.

The functions of any of the above described embodiments may be accomplished not only by executing a program code read out by a computer, but also by causing an operating system (OS) that operates on the computer, to perform a part or the whole of the actual operation according to instructions of the program code.

Furthermore, it is to be understood that the program code read out from the storage medium may be written into a memory provided in an expanded board inserted in the computer, or an expanded unit connected to the computer, and a CPU, or the like, provided in the expanded board or expanded unit may actually perform a part or the whole of the operations according to the instructions of the program code, so as to accomplish the functions of any of the above described embodiments.

Further, the operating screen views of FIGS. 5A to 5D may be displayed on a CRT of a host computer on a network, and the apparatus may be constructed such that the user on the side of the host computer can input, using the screen views, various instructions such as an instruction for designating the sheet type for each sheet feeding port, an instruction for setting the order of priority for each sheet type, an instruction for setting the sheet size or the like, and an instruction as to whether automatic cassette change to a different sheet type should be executed or not, and other instructions. Upon receiving data of such instructions, the host computer may transmit the data via the network to the image forming apparatus, and upon receiving the data, the image forming apparatus may perform various settings according to the instructions, and may perform the optimum sheet selection process in the same manner as in the above described first to third embodiments, to form on the sheets the image data output from the host computer.

What is claimed is:

1. An image forming apparatus for forming image of an original on a sheet, comprising:

a plurality of feeders that feed sheets;

a memory unit that stores priorities between a plurality of sheet types other than sheet sizes and stores sheet sizes and sheet types other than sheet sizes in association with said plurality of feeders;

a selector that selects one of said plurality of feeders to be used for a sheet feeding operation in accordance with at least one of the sheet sizes, the sheet types other than sheet sizes, or the priorities stored in said memory unit; and a controller that controls the feeder selecting operation of said selector, wherein said controller is operable to inhibit said selector from selecting another feeder that contains sheets of a sheet size different from a sheet size of sheets of the selected feeder, after selecting the one feeder, in both a first case where the another feeder contains sheets of a sheet type different from a sheet type of sheets of the selected feeder based on at least the priorities stored in said memory unit, and a second case where the another feeder contains sheets of a same sheet type as the sheet type of the sheets of the selected feeder based on at least the sheet types stored in said memory unit.

2. An image forming apparatus according to claim 1, further comprising an operating section through which a user carries out various settings related to the image forming apparatus, and wherein the sheet types other than sheet sizes stored in said memory unit are set through said operating section.

3. An image forming apparatus according to claim 1, further comprising an operating section through which a user carries out various settings related to the image forming apparatus, and wherein the priorities stored in said memory unit are set through said operating section.

4. An image forming apparatus according to claim 1, further comprising a detector for detecting a size of an original, and wherein said selector selects one of said plurality of feeders to be used for the sheet feeding operation in accordance with the size of the original detected by said detector, the sheet sizes, the sheet types other than sheet sizes, or the priorities stored in said memory unit.

5. An image forming apparatus according to claim 1, wherein said selector carries out selection of one of said plurality of feeders upon start of an image forming operation by said image forming apparatus.

6. An image forming apparatus according to claim 1, wherein said selector carries out selection of one of said plurality of feeders when a feeder being used has run short of sheets during an image forming operation by said image forming apparatus.

7. An image forming apparatus according to claim 6, wherein said selector selects a feeder that contains sheets of the same type as the type of the sheet contained in the feeder which has run short of sheets.

8. A method of controlling an image forming apparatus including a plurality of feeders that feed sheets and an image forming unit, the method comprising:

a first step of storing sheet sizes in a memory unit in association with said plurality of feeders;

a second step of storing sheet types other than sheet sizes in said memory unit in association with said plurality of feeders;

a third step of storing priorities between the sheet types other than sheet sizes in said memory unit;

a fourth step of selecting one of said plurality of feeders to be used for a sheet feeding operation in accordance with at least one of the sheet sizes, the sheet types other than sheet sizes or the priorities stored in said memory unit; and a fifth step of inhibiting a selection of another feeder that contains sheets of a sheet size different from a sheet size of sheets of the selected feeder, after selecting the one feeder, in both a first case where the another feeder contains sheets of a sheet type different from a sheet type of sheets of the selected feeder based on at least the priorities stored in said memory unit, and a second case where the another feeder contains sheets of a same sheet type as the sheet type of the sheets of the selected feeder based on at least the sheet types stored in said memory unit.

9. A method of controlling an image forming apparatus according to claim 8, wherein said image forming apparatus includes an operating section through which a user carries out various settings related to the image forming apparatus, the sheet types other than sheet sizes stored in said second step being set through said operating section.

10. A method of controlling an image forming apparatus according to claim 8, wherein said image forming apparatus includes an operating section on which a user carries out various settings related to the image forming apparatus, the priorities stored in said third step being set through said operating section.

11. A method of controlling an image forming apparatus according to claim 8, further comprising a sixth step of detecting a size of an original, and wherein said fourth step comprises selecting one of said plurality of feeders to be used for the sheet feeding operation in accordance with the size of the original detected in said fifth step, the sheet sizes stored in said first step, the sheet types other than sheet sizes stored in said second step, or the priorities stored in said third step.

12. A method of controlling an image forming apparatus according to claim 8, wherein said fourth step comprises carrying out selection of one of said plurality of feeders upon start of an image forming operation by said image forming apparatus.

13. A method of controlling an image forming apparatus according to claim 8, wherein said fourth step comprises carrying out selection of one of said plurality of feeders when a feeder being used has run short of sheets during an image forming operation by said image forming apparatus.

14. A method of controlling an image forming apparatus according to claim 13, wherein said fourth step comprises selecting a feeder that contains sheets of the same type as the type of the sheet contained in the feeder which has run short of sheets.

15. A storage medium storing a control program for controlling an image forming apparatus including a plurality of feeders that feed sheets and an image forming unit, the storage medium being readable by the image forming apparatus, the control program comprising:

a first code for storing sheet sizes in a memory unit in association with said plurality of feeders;

a second code for storing sheet types other than sheet sizes in said memory unit in association with said plurality of feeders;

a third code for storing priorities between the sheet types other than sheet sizes in said memory unit;

a fourth code for selecting one of said plurality of feeders to be used for a sheet feeding operation in accordance with at least one of the sheet sizes, the sheet types other than sheet sizes, or the priorities stored in said memory unit; and a fifth code for inhibiting a selection of another feeder that contains sheets of a sheet size different from a sheet size of sheets of the selected feeder, after selecting the one feeder, in both a first case where the another feeder contains sheets of a sheet type different from a sheet type of sheets of the selected feeder based on at least the priorities stored in said memory unit, and a second case where the another feeder contains sheets of a same sheet type as the sheet type of the sheets of the selected feeder based on at least the sheet types stored in said memory unit.

16. An image forming apparatus comprising:

an image forming unit;

a plurality of feeders that contain sheets;

a memory unit that stores data related to sheet types other than sheet sizes in association with the feeders;

a selector that selects one of said plurality of feeders in accordance with the data related to sheet types other than sheet sizes stored in said memory unit;

a setting unit that performs a predetermined setting; and a controller that controls a feeder selecting operation of said selector, wherein said selector selects another feeder that contains sheets of a same type as a sheet type of sheets of the selected feeder, based on the data related to sheet types stored in said memory unit, when the selected feeder has run short of sheets during an image forming operation, and wherein said controller is operable, when the predetermined setting is performed by said setting unit, to permit said selector to select another feeder that contains sheets of a different type from a sheet type of the sheets of the selected feeder when the selected feeder has run short of sheets during an image forming operation and there is no other feeder that contains sheets of the same type as the sheet type of the sheets of the selected feeder.

17. An image forming apparatus comprising:

a plurality of feeders that contain sheets;

a memory unit that stores at least one of first data related to priorities between a plurality of sheet types other than sheet sizes and second data related to sheet types other than sheet sizes in association with said plurality of feeders;

a selector that selects one of said plurality of feeders based on at least one of the first data or the second data stored in said memory unit; and a controller that controls a feeder selecting operation of said selector, wherein said controller is operable to inhibit said selector from selecting another feeder that contains sheets of a sheet size different from a sheet size of sheets of the selected feeder, after selecting the one feeder, in both a first case where the another feeder contains sheets of a sheet type different from a sheet type of sheets of the selected feeder based on at least the first data, and a second case where the another feeder contains sheets of a same sheet type as the sheet type of the sheets of the selected feeder based on at least the second data.

18. An image forming apparatus comprising:

a plurality of sheet storage units that store sheets, including at least a first storage unit for storing sheets of a first size and a first type, and a second storage unit;

an image forming unit that performs an image forming operation by using at least one of said plurality of storage units;

an operation selector that selects one of a first operation or a second operation; and a controller that controls use of said plurality of sheet storage units based on the one of the first operation or the second operation selected by said operation selector, wherein said controller is operable, when the first operation is selected, to inhibit use of said second storage unit after said first storage unit has been used, when said second storage unit is for storing sheets of a second type but stores sheets of the first size, and operable, when the second operation is selected, to permit use of said second storage unit after said first storage unit has been used, when said second storage unit is for storing sheets of the second type but stores sheets of the first size.

19. An image forming apparatus for forming an image on a sheet, comprising:

a plurality of feeders for feeding sheets;

a memory for storing sheet types other than sheet sizes in association with the feeders; and a selector for selecting one of said plurality of feeders in accordance with the sheet types stored in said memory, wherein said selector selects one of said plurality of feeders in accordance with a designation allowing a change to the feeder that feeds a different type sheet in a case where the selected feeder has run out of sheets during an image forming operation, wherein said selector selects the feeder containing the sheets of a first type in a case where the designation is not designated, and wherein said selector selects among the feeder containing the sheets of the first type and the feeder containing sheets of a second type in a case where the designation is designated.

20. An image forming apparatus comprising:

a plurality of storage units that store sheets, including at least a first storage unit for storing sheets of a first size and a first type, and a second storage unit;

an image forming unit that performs an image forming operation by using at least one of said plurality of storage units; and a controller that controls use of said plurality of sheet storage units, wherein said controller permits use of said second storage unit after said first storage unit has been used, when said second storage unit stores sheets of the first size and the first type, and inhibits use of said second storage unit after said first storage unit has been used, in both a first case where said second storage unit stores sheets of the first size and a second type, and a second case where said second storage unit stores sheets of a second size and the first type.

21. An image forming apparatus for forming an image on a sheet, comprising:

a plurality of feeders for feeding sheets;

a memory for storing sheet sizes and sheet types in association with the feeders; and a selector for selecting one of said plurality of feeders in accordance with the sheet sizes and the sheet types stored in said memory, wherein, when the selected feeder runs short of sheets in a case where a designation allowing a change to the feeder that feeds a different type sheet is designated, said selector selects the other feeder that contains sheets of the same size and a sheet type different from the sheet type of sheets that have been fed until then, if there is no feeder that contains sheets of the same size and the same type as the sheet size and the sheet type of sheets that have been fed until then.

22. An image forming apparatus according to claim 21, wherein, when the selected feeder runs short of sheets in a case where said designation is not designated, a feeding operation of said plurality of feeders is stopped, if there is no feeder that contains sheets of the same size and the same type as the sheet size and the sheet type of sheets that have been fed until then.

23. An image forming apparatus according to claim 22, wherein a message indicating a sheet exhaustion is displayed on an operation panel when the feeding operation of said plurality of feeders is stopped.

24. An image forming apparatus according to claim 21, wherein, when the selected feeder runs short of sheets, said selector selects the other feeder that contains sheets of the same size and the same type as the sheet size and the sheet type of sheets that have been fed until then.

25. An image forming apparatus according to claim 21, further comprising an operation panel for designating the designation allowing a change to the feeder that feeds a different type sheet in a case where the selected feeder has run short of sheets during an image forming operation.

26. A method of controlling an image forming apparatus having an image forming unit, and a plurality of feeders that contain sheets, comprising:

causing said image forming apparatus to select one of said plurality of feeders in accordance with data related to sheet types other than sheet sizes stored in association with said plurality of feeders;

causing said image forming apparatus to select another feeder that contains sheets of a same type as a sheet type of sheets of the selected feeder, based on the data related to sheet types when the selected feeder has run short of sheets during an image forming operation; and permitting said image forming apparatus to select another feeder that contains sheets of a different type from a sheet type of the sheets of the selected feeder when the selected feeder has run short of sheets during an image forming operation and there is no other feeder that contains sheets of the same type as the sheet type of the sheets of the selected feeder, when a predetermined setting is performed.

27. A method of controlling an image forming apparatus according to claim 26, wherein:

said image forming apparatus is connected to a host computer and includes a scanner unit and a user interface unit;

said image forming unit is for performing an image forming operation based on at least one of data from said scanner unit or data from said host computer; and said image forming apparatus is for performing an operation based on at least an instruction input via said user interface unit of said image forming apparatus.

28. A method of controlling an image forming apparatus according to claim 26, wherein:

said image forming apparatus is connected to a host computer having a user interface unit and includes a scanner unit;

said image forming unit is for performing an image forming operation based on at least one of data from said scanner unit or data from said host computer; and said image forming apparatus is for performing an operation based on at least an instruction input via said user interface unit of said host computer.

29. A method of controlling an image forming apparatus having an image forming unit, and a plurality of feeders that contain sheets, comprising the steps of:

causing said image forming apparatus to select one of said plurality of feeders based on at least one of first data related to priorities between a plurality of sheet types other than sheet sizes or second data related to sheet types other than sheet sizes, the first data and the second data being stored in association with said plurality of feeders; and inhibiting selection of another feeder that contains sheets of a sheet size different from a sheet size of sheets of the selected feeder, after selecting the one feeder, in both a first case where the another feeder contains sheets of a sheet type different from a sheet type of sheets of the selected feeder and the selection is based on at least the first data, and a second case where the another feeder contains sheets of a same sheet type as the sheet type of the sheets of the selected feeder and the selection is based on at least the second data.

30. A method of controlling an image forming apparatus according to claim 29, wherein:

said image forming apparatus is connected to a host computer and includes a scanner unit and a user interface unit;

said image forming unit is for performing an image forming operation based on at least one of data from said scanner unit or data from said host computer; and said image forming apparatus is for performing an operation based on at least an instruction input via said user interface unit of said image forming apparatus.

31. A method of controlling an image forming apparatus according to claim 29, wherein:

said image forming apparatus is connected to a host computer having a user interface unit and includes a scanner unit;

said image forming unit is for performing an image forming operation based on at least one of data from said scanner unit or data from said host computer; and said image forming apparatus is for performing an operation based on at least an instruction input via said user interface unit of said host computer.

32. A method of controlling an image forming apparatus a plurality of sheet storage units that store sheets, including at least a first storage unit for storing sheets of a first size and a first type, and a second storage unit, and an image forming unit that performs an image forming operation by using at least one of said plurality of storage units, comprising the steps of:

selecting one of a first operation or a second operation;

inhibiting use of said second storage unit after said first storage unit has been used when said second storage unit is for storing sheets of a second type but stores sheets of the first size, when the first operation is selected; and permitting use of said second storage unit after said first storage unit has been used, when said second storage unit is for storing sheets of the second type but stores sheets of the first size, when the second operation is selected.

33. A method of controlling an image forming apparatus according to claim 32, wherein:

said image forming apparatus is connected to a host computer and includes a scanner unit and a user interface unit;

said image forming unit is for performing an image forming operation based on at least one of data from said scanner unit or data from said host computer; and said image forming apparatus is for performing an operation based on at least an instruction input via said user interface unit of said image forming apparatus.

34. A method of controlling an image forming apparatus according to claim 32, wherein:

said image forming apparatus is connected to a host computer having a user interface unit and includes a scanner unit;

said image forming unit is for performing an image forming operation based on at least one of data from said scanner unit or data from said host computer; and said image forming apparatus is for performing an operation based on at least an instruction input via said user interface unit of said host computer.

35. A method of controlling an image forming apparatus having a plurality of storage units that store sheets, including at least a first storage unit for storing sheets of a first size and a first type, and a second storage unit, and an image forming unit that performs an image forming operation by using at least one of said plurality of storage units, comprising the steps of:

permitting use of said second storage unit after said first storage unit has been used, when said second storage unit stores sheets of the first size and the first type; and inhibiting use of said second storage unit after said first storage unit has been used, in both a first case where said second storage unit stores sheets of the first size and a second type, and a second case where said second storage unit stores sheets of a second size and the first type.

36. A method of controlling an image forming apparatus according to claim 35, wherein:

said image forming apparatus is connected to a host computer and includes a scanner unit and a user interface unit;

said image forming unit is for performing an image forming operation based on at least one of data from said scanner unit or data from said host computer; and said image forming apparatus is for performing an operation based on at least an instruction input via said user interface unit of said image forming apparatus.

37. A method of controlling an image forming apparatus according to claim 35, wherein;

said image forming apparatus is connected to a host computer having a user interface unit and includes a scanner unit;

said image forming unit is for performing an image forming operation based on at least one of data from said scanner unit or data from said host computer; and said image forming apparatus is for performing an operation based on at least an instruction input via said user interface unit of said host computer.

* * * * *